US007228589B2

(12) United States Patent
Miner et al.

(10) Patent No.: US 7,228,589 B2
(45) Date of Patent: Jun. 12, 2007

(54) UNATTENDED SPOT CLEANING APPARATUS

(75) Inventors: Jonathan L. Miner, Rockford, MI (US); Eric C. Huffman, Lowell, MI (US); Eric C. Sugalski, Chicago, IL (US); Kevin J. Ehrenreich, Chicago, IL (US); Mark P. Slaven, Evanston, IL (US); Tomas A. Matusaitis, Chicago, IL (US); Randall S. Koplin, Chicago, IL (US); Jeff R. Condon, Chicago, IL (US); Phong Hoang Tran, Caledonia, MI (US); David Seal, Chicago, IL (US); Jeremy Moog, Ada, MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 0 days.

(21) Appl. No.: 10/551,169

(22) PCT Filed: Mar. 31, 2004

(86) PCT No.: PCT/US2004/009927

§ 371 (c)(1),
(2), (4) Date: Sep. 28, 2005

(87) PCT Pub. No.: WO2004/089179

PCT Pub. Date: Oct. 21, 2004

(65) Prior Publication Data

US 2006/0179599 A1 Aug. 17, 2006

Related U.S. Application Data

(60) Provisional application No. 60/320,071, filed on Mar. 31, 2003.

(51) Int. Cl.
*A47L 11/30* (2006.01)

(52) U.S. Cl. ..... 15/320; 15/380; 15/385

(58) Field of Classification Search ..... 15/320, 15/340.1, 340.2, 340.3, 340.4, 385, DIG. 10
See application file for complete search history.

(56) References Cited

U.S. PATENT DOCUMENTS

| | | | |
|---|---|---|---|
| 1,240,799 | A | 9/1917 | Gray |
| 4,295,243 | A | 10/1981 | King |
| 4,441,229 | A | 4/1984 | Monson |
| 4,939,808 | A | 7/1990 | Roden et al. |
| 5,867,860 | A | 2/1999 | Harris |
| 6,446,302 | B1 | 9/2002 | Kasper et al. |
| 6,467,122 | B2 | 10/2002 | Lenkiewicz et al. |

FOREIGN PATENT DOCUMENTS

| | | |
|---|---|---|
| DE | 8521143 U | 2/1987 |
| DE | 4425782 A1 | 1/1996 |
| JP | 04-042099 | 2/1992 |

*Primary Examiner*—Terrence R. Till
(74) *Attorney, Agent, or Firm*—McGarry Bair PC

(57) ABSTRACT

A spot cleaning apparatus comprises a housing, a fluid distribution system, a fluid recovery system, an agitation system, and a controller system to automatically monitor and control inputs and outputs to said systems for removal of spots and stains from a surface without attendance by a user. A suction nozzle and agitation device are mounted to the housing for movement over the surface to be cleaned relative to a stationary housing. Optionally, the spot cleaning apparatus can be operated in a manual mode.

50 Claims, 26 Drawing Sheets

UNATTENDED SPOT CLEANING APPARATUS

CROSS-REFERENCE TO RELATED APPLICATIONS

This application claims priority on International Application No. PCT/US2004/009927, filed Mar. 31, 2004, which claims the benefit of U.S. provisional application Ser. No. 60/320,071, filed Mar. 31, 2003, which is incorporated herein by reference in its entirety.

BACKGROUND OF THE INVENTION

1. Field of the Invention

This invention relates to extraction cleaning devices. In one of its aspects, the invention relates to an extraction-cleaning machine that is adapted to clean spots in carpet and other fabric surfaces. In yet another aspect, the invention relates to an extraction cleaning machine with an improved scrubbing or agitation implement. In yet another aspect, the invention relates to an extraction cleaning machine with an air purifier. In yet another aspect, the invention relates to a spot cleaner for carpet and bare floors that can function unattended by a user. In yet another of its aspects, the invention relates to a floor cleaning apparatus that has a cord wrap that can be retracted into the apparatus housing when not in use.

2. Description of the Related Art

Japanese Patent Application Publication No. 04-042099, published Feb. 12, 1992, discloses a stationary floor cleaning device for removal of radioactive material. To operate the device, the user manually selectively actuates three electrical switches to activate a vacuum motor, a fluid delivery pump or a rotating brush.

U.S. patent application Ser. No. 09/755,724, published on Dec. 6, 2001, discloses an upright deep cleaning extraction machine comprising a base movable across the surface to be cleaned, an upright handle pivotally attached to the base, a fluid distribution system, a recovery system and an agitation system. The fluid distribution system comprises a clean fluid tank, a delivery valve and a spray nozzle, each of which are in fluid communication via a conduit. Upon activation of the delivery valve, fluid is delivered under force of gravity through the spray nozzle and onto the surface being cleaned. A suction nozzle is located at a forward end of the base and provides an entry point for liquid extraction through a working air conduit that is in fluid communication with a dirty water recovery tank. A vacuum motor driving a fan is positioned downstream of the recovery tank to create a working airflow. A rotating scrubbing implement is mounted horizontally in spaced relation behind the suction nozzle. The brush can be rotated via a belt driven by the vacuum motor or alternatively via an air driven turbine.

U.S. Pat. No. 6,446,302 to Kasper et al. discloses an extraction cleaning machine with floor condition sensing devices and controllers for the cleaning operation. A controller sends signals to a variable control cleaning system in response to signals received from the condition sensors. The condition sensors and controllers are mounted to an upright deep cleaner wherein movement of the cleaner can be accomplished by motive force generated by the user.

U.S. patent application Ser. No. 10/065,891 to Lenkiewicz discloses a commercially available portable extraction cleaning device known as the BISSELL Little Green Clean Machine Model 1400, 1425, or 1425-1 that incorporates a fluid distribution and recovery system similar to that of a larger extraction device in a smaller configuration.

SUMMARY OF THE INVENTION

According to the invention, a floor cleaning apparatus comprises a housing that mounts a fluid delivery system including a fluid distributor for delivering a cleaning fluid to a surface to be cleaned, a fluid extraction system including a suction nozzle for recovering soiled cleaning fluid from the surface to be cleaned and, optionally, a scrubbing implement for scrubbing contact with the surface to be cleaned.

In one embodiment, the housing has a bottom portion that is adapted to rest on a surface being cleaned and a carriage assembly support above an opening in an underside of the housing. A carriage mounts the fluid distributor and the suction nozzle to the carriage assembly support for translational movement with respect to the housing so that the suction nozzle and the fluid distributor move laterally with respect to the surface to be cleaned in the opening in the housing.

Preferably, the scrubbing implement is mounted to the carriage for movement with the fluid distributor and the suction nozzle. Preferably, the scrubbing implement is a brush but it can also be a cloth or a foam pad. Further, the scrubbing implement, the fluid distributor and the suction nozzle move as a unit with respect to the housing.

In a preferred embodiment of the invention, a resilient biasing element is mounted between the carriage and the carriage assembly support for resiliently biasing the suction nozzle and the scrubbing implement, if any, onto the surface to be cleaned. The biasing force of the biasing element is less than the weight of the housing.

In one embodiment of the invention, the translational movement is orbital. In this embodiment, the carriage includes a gear system for motion of the fluid distributor and the suction nozzle with respect to the housing.

In another embodiment, the translational movement is linear. In still another embodiment, the translational movement is circular.

The fluid distributor can take a variety of forms. In a preferred embodiment, the distributor comprises one or more spray nozzles. Alternatively, the distributor can be a manifold with spaced openings.

The suction nozzle is typically an elongated slot but can take a variety of shapes. In one embodiment, the suction nozzle is L-shaped. In another embodiment, the suction nozzle is T shaped.

Typically, the carriage will be driven by an electrical motor although a manual crank can also be used to drive the carriage. Preferably, a motor mounted to the housing and connected to the carriage for driving the translational movement of the carriage with respect to the housing. A power supply for the motor is carried by the housing and a controller is mounted to the housing and to the motor for controlling the power supply to the motor. In one embodiment, the controller is programmed to supply power to the motor for a first predetermined period of time and to discontinue power to the motor for a second predetermined period of time. In a preferred embodiment of the invention, the controller has a timer that turns the motor off after a predetermined period of time for unattended cleaning of a spot on a floor surface, such as a carpet.

In one embodiment of the invention, the fluid supply system comprises a first fluid tank with an outlet opening and a second fluid tank with an outlet opening, wherein the outlet openings of the first fluid tank and the second fluid tank are connected to supply a mixture of a a first fluid from the first fluid tank and a second fluid from the second fluid tank to the fluid distributor. The outlet openings of the first fluid tank and the second fluid tank can be connected through a mixing valve. A controller is mounted to the housing and is connected to the mixing valve, and the controller is programmed to control the relative amounts of the first and second fluids combined in the mixing valve. The controller can be programmed to control the mixing valve to deliver a predetermined concentration of the first fluid and the second fluid to the fluid distributor for a first predetermined length of time and to deliver the second fluid for a rinse cycle for a second predetermined length of time. The fluid supply system can further comprise a controllable flow valve or a controllable pump between the mixing valve and the fluid distributor and the controller is connected to the controllable flow valve or controllable pump to control the flow of fluid from the mixing valve to the fluid distributor. The controller can be programmed to open the flow control valve or operate the pump during a third predetermined period of time and to close the flow control valve or cease operation of the pump during a fourth predetermined period of time.

In another embodiment of the invention, the fluid extraction system further comprises a hose connected at one end to the housing and at another end to a surface cleaning tool for extraction of fluids from surfaces other than beneath the opening in the underside of the housing. In addition, the fluid supply system can include a fluid supply conduit associated with the hose and connected to the surface cleaning tool for delivering fluids to areas other than beneath the opening in the underside of the housing.

In yet another embodiment of the invention, a cord wrap element is mounted to the housing for movement between an extended position for wrapping an electrical cord in a compact configuration and a retracted position for concealing the cord wrap element.

In yet another embodiment of the invention, an ion generator is mounted on the housing.

According to an important aspect of the invention is that a floor cleaner can be used in an unattended mode or can optionally be utilized in a manual mode. A user identifies a stained portion of a surface to be cleaned, e.g., a carpeted or upholstered surface, fills the spot cleaner with necessary cleaning fluids, places the spot cleaner over the stain, and energizes the spot cleaner. The spot cleaner, without further intervention by the user, detects the condition of the surface to be cleaned, applies the appropriate cleaning fluids, agitates the stained portion as necessary, suctions excess cleaning fluids from the surface, and provides external status indications with respect to cleaning status. The user returns, at his or her convenience, to the spot cleaner, removes the spot cleaner from the surface to be cleaned, and manually empties the excess fluid recovered during the cleaning process.

DETAILED DESCRIPTION OF THE PREFERRED EMBODIMENTS

Figure 1:
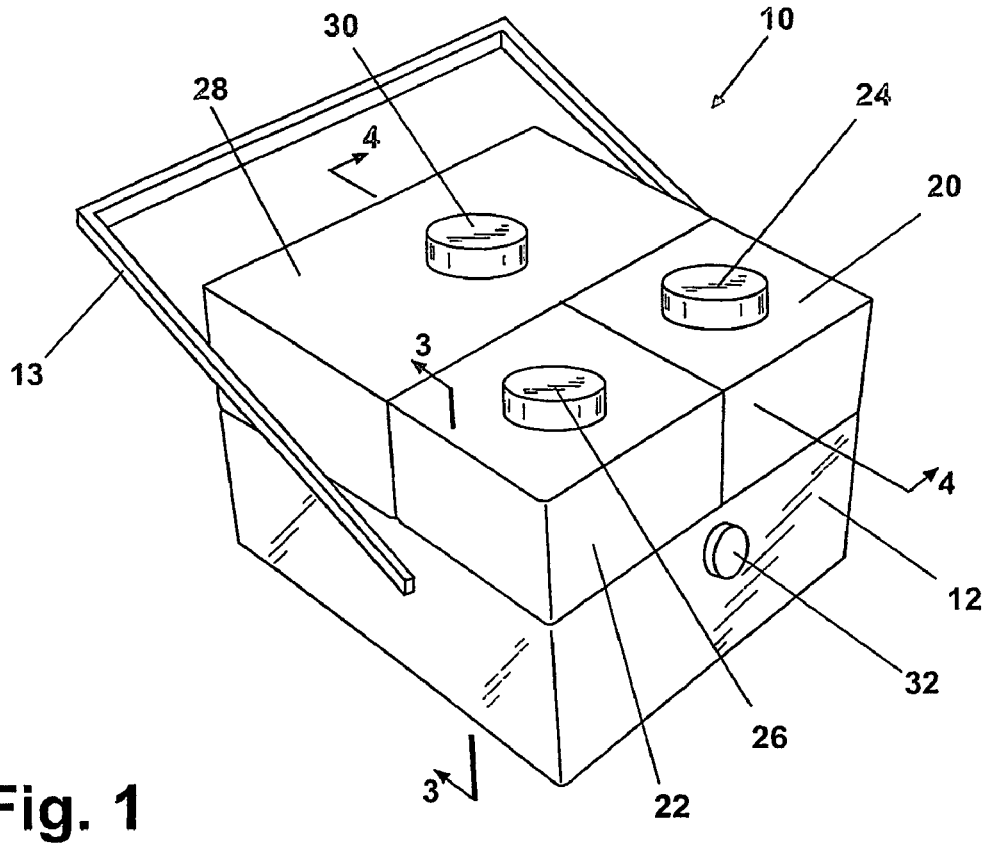
FIG. 1 is a top perspective view of an unattended spot cleaning apparatus according to the invention.

Referring to the drawings and in particular FIGS. 1–5, an unattended spot cleaning apparatus 10 comprises an enclosure 12, a housing 14, a fluid distribution system 11, a fluid recovery system 17, an agitation system 19, a drive rack assembly 21, floor condition sensors 23, and a power distribution system 25. At least a portion of the enclosure 12 is preferably made of a transparent material so that the surface to be cleaned is visible to the user. A U-shaped handle 13 is rotatably attached to opposing side walls of the enclosure 12. The handle 13 is of sufficient size so that a space is formed between a bottom surface of the handle 13 and a top surface of enclosure 12 when the handle 13 is in an upright position. Furthermore, the handle 13 is shaped so that a top surface of the spot cleaning apparatus 10 is unobstructed when the handle 13 is rotated to a horizontal position. A rack support structure 16 is mounted to a top surface of the housing 14. The housing 14 comprises a generally plate-like structure that is mounted to the bottom of the enclosure 12 and forms a cleaning aperture 18 that facilitates direct access of internal components of the spot cleaning apparatus 10 to the surface being cleaned. A plurality of cylindrical grippers 15 are located on a bottom surface of the housing 14. Alternatively, the grippers 15 can be replaced with a commonly known hook portion of a hook and loop fastening system or any other device that increases the friction between carpet and the base 14 and, thus, minimizes relative movement between housing 14 and the surface to be cleaned to minimize movement between the spot cleaning apparatus 10 and the surface being cleaned.

Figure 2:
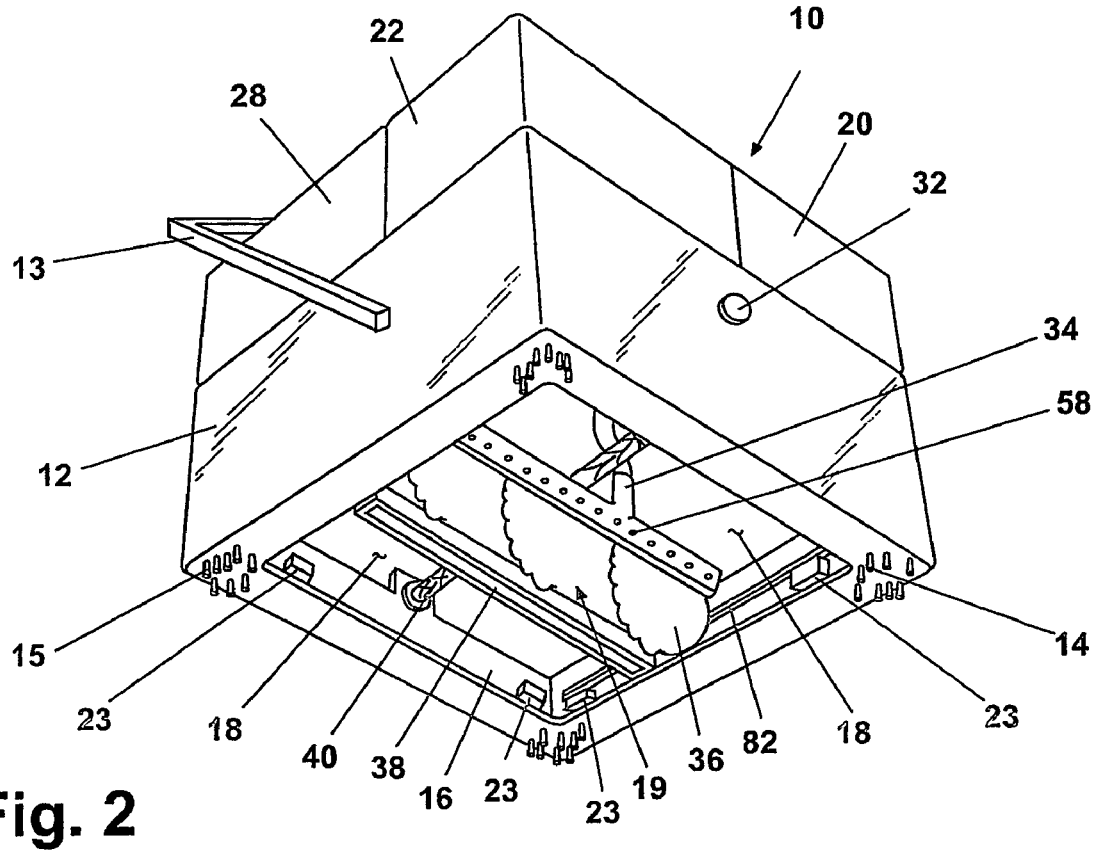
FIG. 2 is a bottom perspective view of the unattended spot cleaning apparatus shown in FIG. 1.

The fluid distribution system 11 comprises a first fluid tank 20 removably mounted to a top of the enclosure 12. A second fluid tank 22 is removably mounted adjacent to the first fluid tank 20 and also on the top surface of the enclosure 12. A first cap 24 sealingly mates with an opening in the first fluid tank 20. A second cap 26 sealingly mates with an opening in the second fluid tank 22. The caps 24, 26 have a small aperture therethrough to vent the respective tanks 20, 22. A recovery tank 28 is removably mounted to the top surface of the enclosure 12 and adjacent to the first fluid tank 20 and the second fluid tank 22. A recovery tank cap 30 sealingly mates with an opening in the recovery tank 28. A power switch 32 is directly accessible to the user on an outer surface of the enclosure 12. Referring to FIG. 2, a distribution manifold 34 is positioned within the cleaning aperture 18. A scrubbing implement 36 is mounted parallel to the distribution manifold 34. A suction nozzle 38 is located adjacent to the scrubbing implement 36. The distribution manifold 34, the scrubbing implement 36, and the suction nozzle 38 are mounted on the rack support structure 16 and are movable laterally therewith and within the cleaning aperture 18.

Figure 3:
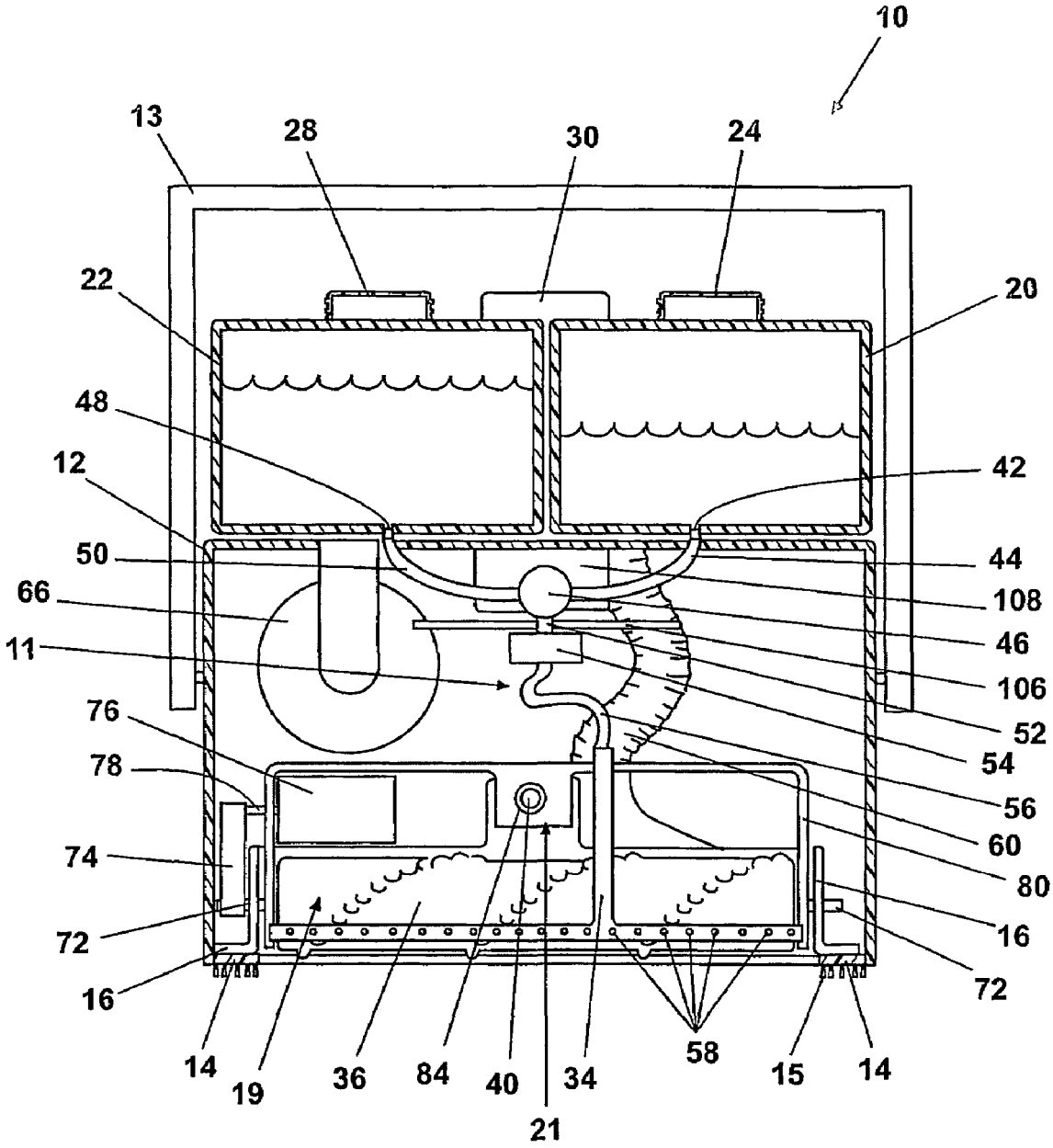
FIG. 3 is a schematic sectional view taken along line 3—3 of FIG. 1 and showing a fluid distribution system.
Figure 5:
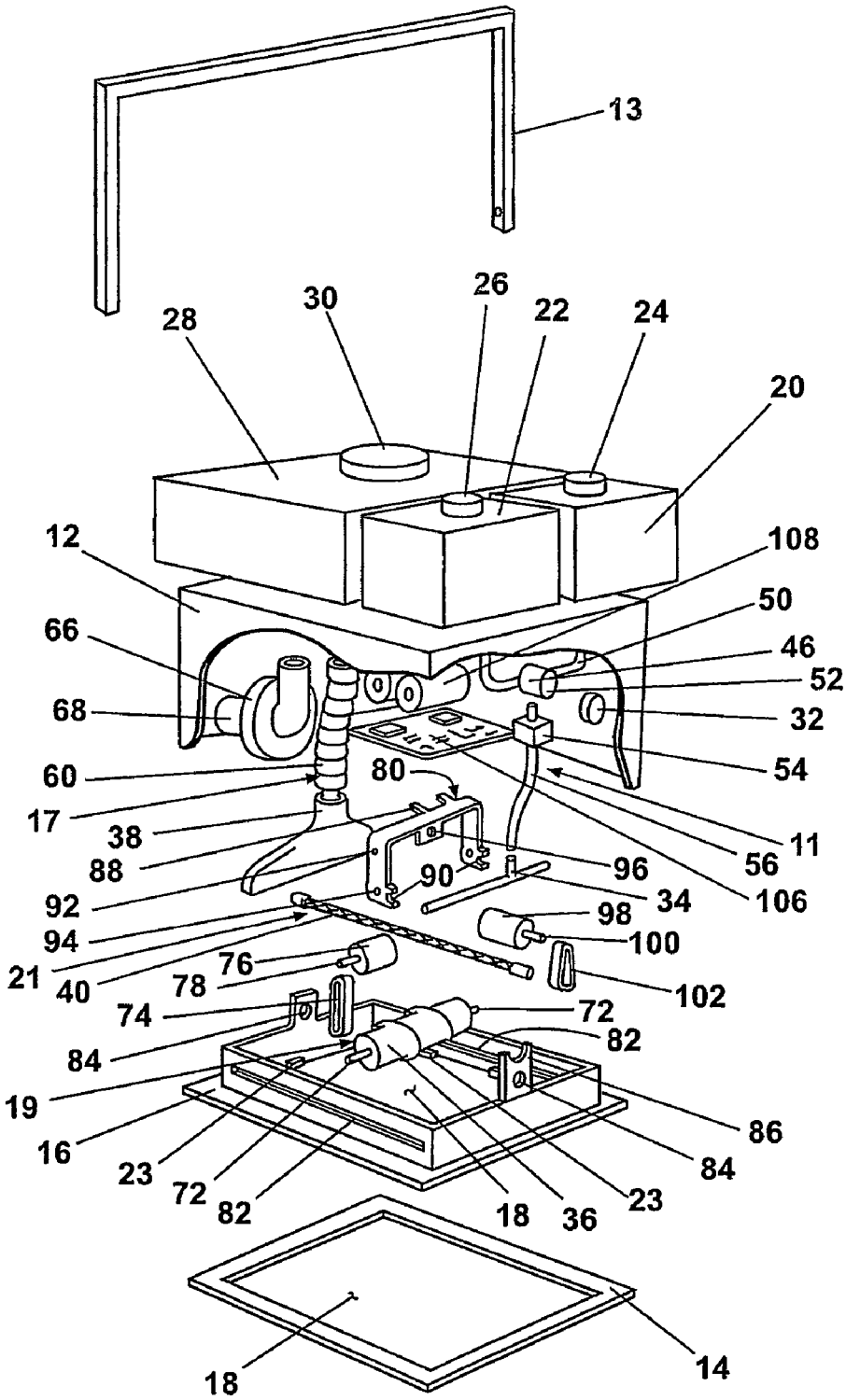
FIG. 5 is an exploded view of the unattended spot cleaning apparatus shown in FIG. 1 with a portion of a top enclosure broken away.

Referring to FIGS. 3 and 5, the fluid distribution system 11 further comprises a first outlet valve 42 located within an outlet opening of the first tank 20. The first outlet valve 42 is spring biased to a closed position when first fluid tank 20 is removed from the spot cleaning apparatus 10. A protrusion associated with the enclosure aligns with the first outlet valve 42 and, upon engagement, overcomes the spring force to create an opening in fluid communication with a first conduit 44. An example of a suitable outlet valve is disclosed in U.S. Pat. No. 6,467,122 to Lenkiewicz, which is incorporated herein by reference in its entirety. The first conduit 44 is in fluid communication with a first inlet into a mixing valve solenoid 46. A second outlet valve 48 is positioned in an outlet in the second fluid tank 22 in a fashion similar to that previously described for the first fluid tank 20. The second outlet valve 48 is in fluid communication with a second conduit 50. The second conduit 50 is also in fluid communication with a second inlet to the mixing valve solenoid 46. The mixing valve solenoid 46 is electrically actuated and capable of varying the flow mixture of fluids from the first fluid tank 20 and the second fluid tank 22. A single mixing valve outlet 52 allows mixed fluids from the first fluid tank 20 and the second fluid tank 22 to exit the mixing valve solenoid 46. An example of a suitable mixing valve is disclosed in U.S. Pat. No. 6,131,237 to Kasper, which is incorporated herein by reference in its entirety. The mixing valve outlet 52 is in fluid communication with a fluid solenoid valve 54. The fluid solenoid valve 54 is electrically controlled open and close a fluid delivery conduit 56. The fluid delivery conduit 56 is in fluid communication with the spray nozzle 34. The distribution manifold 34 preferably comprises a plurality of apertures 58 along a lower surface of thereof. Alternatively, the distribution manifold 34 can be a spray nozzle. As can be appreciated, the size and number of the fluid tanks 20, 22 can vary. Furthermore, the fluid tanks 20, 22 can be flexible, collapsible bladders as more fully described in U.S. Pat. No. 6,446,302 to Kasper et al., which is incorporated herein by reference in its entirety. A plurality of chemical compositions including, but not limited to, detergent, oxidizers, disinfectants, miticides, fragrances, protectants or other compounds, and other fluids, such as water, can be stored in the fluid tanks 20, 22.

Alternatively, a pump can be used to provide fluid under pressure to the distribution manifold 34. One such example is found in the previously referenced U.S. Pat. No. 6,446,302 to Kasper et al.

In yet another alternative embodiment, the fluid tanks 20, 22 can be pressurized with an aerosol propellant. The fluid can be distributed through the previously described fluid solenoid valve 54 or through an alternative delivery system. Optionally, a heater can be incorporated within the fluid distribution system to heat the fluid to a temperature less than boiling prior to reaching the surface to be cleaned. One example of such a fluid heater can be found in U.S. Pat. No. 6,131,237 to Kasper et al., which is incorporated herein by reference in its entirety.

Figure 4:
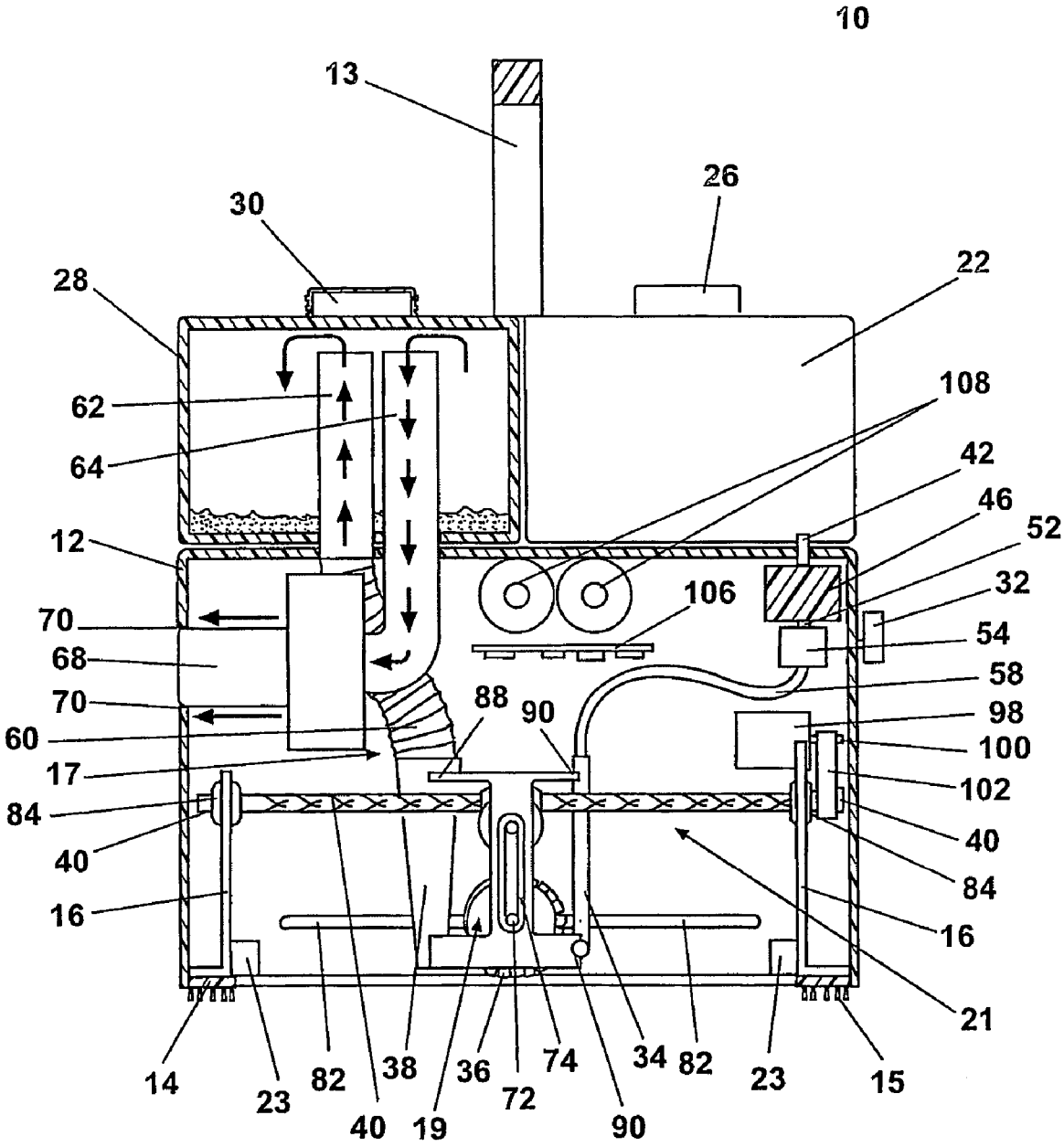
FIG. 4 is a schematic sectional view taken along line 4—4 of FIG. 1 and showing a fluid recovery system.

Referring to FIGS. 4 and 5, the fluid recovery system 17 further comprises the suction nozzle 38. The suction nozzle 38 has a relatively narrow width aperture in close proximity to the surface being cleaned. An outlet of the suction nozzle 38 is in fluid communication with a flexible suction conduit 60. A second end of the flexible suction conduit 60 is in fluid communication with an inlet standpipe 62. The inlet standpipe 62 extends into recovery tank 28. A gasket assembly seals the inlet standpipe 62 to the suction conduit 60 such that fluid communication is achieved when the recovery tank 28 is mounted to the top of enclosure 12. An outlet standpipe 64 is mounted within the recovery tank 28 with a sealing gasket assembly similar to that described above for the inlet standpipe 62 so that fluid communication is achieved when the recovery tank 28 is mounted to the enclosure 12. Alternatively, the air inlet and outlet through the recovery tank 28 can be configured as shown in the commercially available BISSELL Little Green Clean Machine Model 1400, Model 1425, or Model 1425-1 portable extraction cleaner and disclosed in U.S. patent application Ser. No. 10/065,891 to Lenkiewicz, which is incorporated herein by reference in its entirety. A fan housing with an inlet and an outlet is mounted within the enclosure 12. A fan 66 is rotatably mounted within the fan housing. The inlet of the fan 66 is in fluid communication with the outlet of the outlet standpipe 64. A fan motor 68 is in communication with the fan 66. In the first embodiment, the motor 68 is preferably an electrical motor. When power is supplied to the fan motor 68, the fan motor 68 turns a shaft that rotates the fan 66. As the fan 66 rotates, airflow is generated through the fan 66 and the fan housing. An exhaust aperture 70 is located on an outer surface of the enclosure 12 and is in fluid communication with the fan inlet 66.

The agitation system 19 comprises a scrubbing implement 36. In a first embodiment, the scrubbing implement 36 is a brush roll mounted in a horizontal position relative to the surface to be cleaned. A brush axle 72 is located on a centerline axis of the scrubbing implement 36 and extends from both ends of the scrubbing implement 36. The brush drive belt 74 rides on an outer surface of the brush axle 72. A brush motor 76 is located within the enclosure 12 in close proximity to the scrubbing implement 36. A motor shaft 78 extends from the brush motor 76 and is in vertical alignment with the brush axle 72. A drive belt 74 is in operative communication with both the motor shaft 78 and the brush axle 72. Optionally, a pulley can be fixedly attached to both the motor shaft 78 and the brush axle 72 to maintain the position of the drive belt 74 on the shaft 78 and the axle 72. In the first embodiment, the brush drive motor 76 is preferably an electrical motor. Power to the brush motor 76 energizes the brush motor 76 to rotate the shaft 78, the belt 74, the axle 72, and, therefore, the scrubbing implement 36. In a second embodiment, the brush motor 76 can be an air turbine motor driven by the vacuum created by the fan 66.

Referring to FIG. 5, a rack drive assembly 21 comprises a rack support structure 16 and a drive rack 80. Opposing brush slots 82 extend through one pair of opposing side walls of the rack support structure 16 and provide a track on which the scrubbing implement 36 travels. More particularly, the brush axle 72 coincides with the brush slots 82. Drive screw bearings 84 are located on the other pair of opposing walls of the rack support structure 16. A rack drive motor support 86 is located directly above one of the drive screw bearings 84. The drive rack 80 is a generally U-shaped structure that comprises a suction nozzle support 88 that is rigidly attached to suction nozzle 38. The drive rack 80 further includes spray bar supports 90 located on a side opposite the suction nozzle support 88. One end of the U-shaped drive rack 80 comprises a pair of apertures. The top aperture, a brush drive shaft bearing 92, is located directly above the lower aperture, which is a brush axle bearing 94. The motor shaft 78 protrudes through the brush drive shaft bearing 92. The axle shaft 72 protrudes through brush axle bearing 94. A drive screw threaded aperture 96 is located on a centerline of the drive rack 80. Male threads on the drive screw threaded aperture 96 correspond with female threads on a drive screw 40. The drive screw 40 is threaded within the threaded aperture 96 for travel in an axial direction. A drive screw motor 98 is positioned on the rack drive motor support 86. One end of the drive screw 40 protrudes through the drive screw bearing 84. A drive screw motor shaft 100 extends from a centerline of drive screw motor 98. The drive screw shaft 100 is in vertical alignment with drive screw 40. The drive screw belt 102 is in communication with the drive screw shaft 100 and the drive screw 40. In the first embodiment, the drive screw motor 98 is an electrical motor. The drive screw motor 98 rotates upon application of power, causing the shaft 100 to turn, which causes the belt 102 to turn, which then causes the drive screw 40 to turn. As the drive screw 40 turns, the drive rack 80 is caused to move along the length of the drive screw 40 due to the interference between the threaded aperture 96 and the threads on the drive screw 40. When the drive rack 80 reaches the end of the travel in one direction, the female threads on the end of the drive screw 40 are cut such that automatic reversal of the drive rack occurs and the drive rack 80 proceeds along the length of the drive screw 40 in an opposite direction. Similar reversing screw thread designs are incorporated on both ends of the drive screw 40 so that as long as power is applied to the drive motor 98, the drive rack 80 will continuously work its way back and forth along the length of the drive screw 40. Alternatively, the controller 106 reverses polarity on the rack drive motor 98 to cause the rack 80 to reverse directions. The spray nozzle 34, scrubbing implement 36, and suction nozzle 38 also move in correlation with the drive rack 80.

In a second embodiment, the rack drive assembly 21 comprises a reversible motor mounted on the drive rack 80 and further comprises a spur gear fixedly attached to the motor shaft. The rack support structure comprises a gear rack on an upper wall that corresponds with the spur gear on the motor. The controller 106 sends electrical output to the reversible motor, which causes the rack drive assembly to move in a back and forth fashion across the rack support structure. In yet another embodiment, gear racks are formed on the upper surface of two opposite sides of the rack support structure. A second spur gear is rotatably attached to a side of the rack support structure opposite the reversible motor.

Referring to FIGS. 2 and 5, a plurality of floor condition sensors 23 are located on an inside wall of the rack support structure 16. The floor condition sensors 23 are positioned to effectively scan the entire area within the cleaning aperture 18 and measure the relative degree of soil on the surface being cleaned by sensing color variation. The controller 106 is located between the enclosure 12 and the housing 14. The controller 106 comprises a commonly known printed circuit board upon which commonly known computer processing and electronic components are mounted. Batteries 108 are also located in the cavity between the enclosure 12 and the housing 14. The switch 32 selectively controls power from the batteries 108. When switch 32 is on, power flows to the controller 106. The controller 106 receives inputs from the various condition sensors 104 and provides conditioned output to any combination of the suction motor 68, brush drive motor 76, drive screw motor 98, the fluid solenoid valve 54 or the mixing valve solenoid 46. The floor condition sensors 23 are mounted such that the entire area within the cleaning aperture 18 is monitored. Each sensor 23 provides signals relative to the condition of the surface being cleaned to the controller 106 for processing. One such example of a controller and floor condition sensors is disclosed in U.S. Pat. No. 6,446,302 to Kasper et al. issued on Sep. 10, 2002, as previously referenced. Alternatively, the controller can utilize pre-timed programs in the fashion of a commonly known laundry washing machine timing circuit. In an alternate embodiment, the controller output signals are routed to a plurality of visual or audible indicators mounted to the exterior of the enclosure. Indicators can include Light Emitting Diodes (LED's) or signal tone generators. Indicators can convey information such as low fluid, the present stage of the cleaning cycle, or the like.

The batteries 108 can be any commonly known battery source including alkaline or rechargeable nickel cadmium, nickel metal hydride or lithium metal hydride. When rechargeable batteries are used, a commonly known recharging circuit is used to transform commonly available facility voltage to a level suitable for the batteries 108. A charging plug connected to the transformer is manually or automatically attached to the corresponding jack connected to the batteries 108 thereby completing the circuit and allowing the batteries to charge. An example of such a recharging circuit can be found in the commercially available rechargeable stick vacuum sold by BISSELL Homecare, Inc. under the name GoVac or as disclosed in U.S. Pat. No. 6,345,411 to Kato, which is incorporated herein by reference in its entirety. In an alternate embodiment, the rechargeable batteries are eliminated and a direct wire to the facility outlet is supplied. In this configuration, the on/off switch 32 is used to control power from the facility to the controller.

In operation, the user connects the unattended spot cleaning apparatus 10 to facility power to energize the power circuit. Once a full charge on the batteries 108 is reached, the user removes the charging circuit from the unattended spot cleaning apparatus 10. Typically, the user fills first fluid tank 20 with clean water or other suitable aqueous compositions and the other fluid tanks with some type of detergent, protectant, miticide or any other application that is desired on the surface to be cleaned. The user visually scans the surface to be cleaned and determines the particular location in which cleaning is desired. The user places the unattended spot cleaning apparatus 10 over the spot to be cleaned. For spots that fit within the perimeter of aperture 18, a one-time use is all that is required. For spots larger than the perimeter of aperture 18, the steps described below must be repeated by moving the apparatus 10 to the desired location for each succeeding cleaning. Once properly positioned, the on/off switch 32 is engaged and power is delivered to the controller 106. The controller 106 controls output based on information from the floor condition sensors 104. Typically, the drive rack assembly 80 will make a number of passes over the area to be cleaned while the condition sensors 104 monitor the condition of the surface to be cleaned. Depending on the condition of the floor being cleaned, the controller will generate signals to the various drive components. A typical sequence is as follows: the mixing valve solenoid 46 is adjusted to provided the proper mixture of clean water in first fluid tank 20 and detergent or other secondary fluid contained in the other fluid tanks; the fluid solenoid valve 54 is opened allowing mixed fluid to flow under force of gravity to the spray bar 34; the mixed fluid then drips from the apertures on the bottom of fluid bar 34 as fluid bar passes over the area to be cleaned. Once floor condition sensors 104 sense that adequate fluid has been deposited on the floor (or the end of the pre-timed cycle is complete), the fluid solenoid valve 54 is shut off, thus preventing fluid from flowing to the surface to be cleaned. The controller 106 then sends a drive signal to the brush motor 76 causing the scrubbing implement 36 to rotate. The drive rack assembly 80 continues to pass over the spot to be cleaned, now with the scrubbing implement 36 rotating. Once the condition sensors 104 sense adequate agitation of the surface being cleaned, the signal to the brush motor 76 is removed, causing the scrubbing implement 36 to stop rotation. Again, depending on signals delivered by the condition sensors 104 the controller 106 then sends an output signal to the suction motor 68. As the suction motor 68 turns, the fan generates an airflow as depicted by the arrows in FIG. 4. Loose debris and liquid at the surface to be cleaned and within the proximity of the suction nozzle 38 is lifted from the surface to be cleaned, carried through the suction conduit 60 through the inlet standpipe 62 and deposited within the interior of the recovery tank 28. Separation of air, debris and liquid occurs within the interior of the recovery tank 28. Heavier solids and liquids fall to the bottom of the recovery tank 28. Working air is then drawn into the outlet standpipe 64 and into the fan inlet 66. Working air then passes through the fan 66 and is exhausted through the exhaust apertures 70. The condition sensors 104 and controller 106 continue to evaluate the condition of the surface being cleaned and selectively send signals as needed to the various drive components. Once the desired level of cleanliness is achieved (or the pre-timed cleaning cycle ends), power to all of the drive components is removed and the unattended spot cleaning apparatus reverts to an idle mode. Upon returning to the unattended spot cleaning apparatus 10, the user turns off the electrical switch 32, thus removing all power to the controller. The user removes the recovery tank 28 from the enclosure 12 and debris from the recovery tank 28 is dumped into an appropriate disposal receptacle. Similarly, unused or excess fluid in the first fluid tank 20 and other fluid tanks are disposed of as needed or can be stored in the tank for future use. The unattended spot cleaning apparatus 10 is reattached to the charging circuit to replenish power to the batteries 108.

Figure 6:
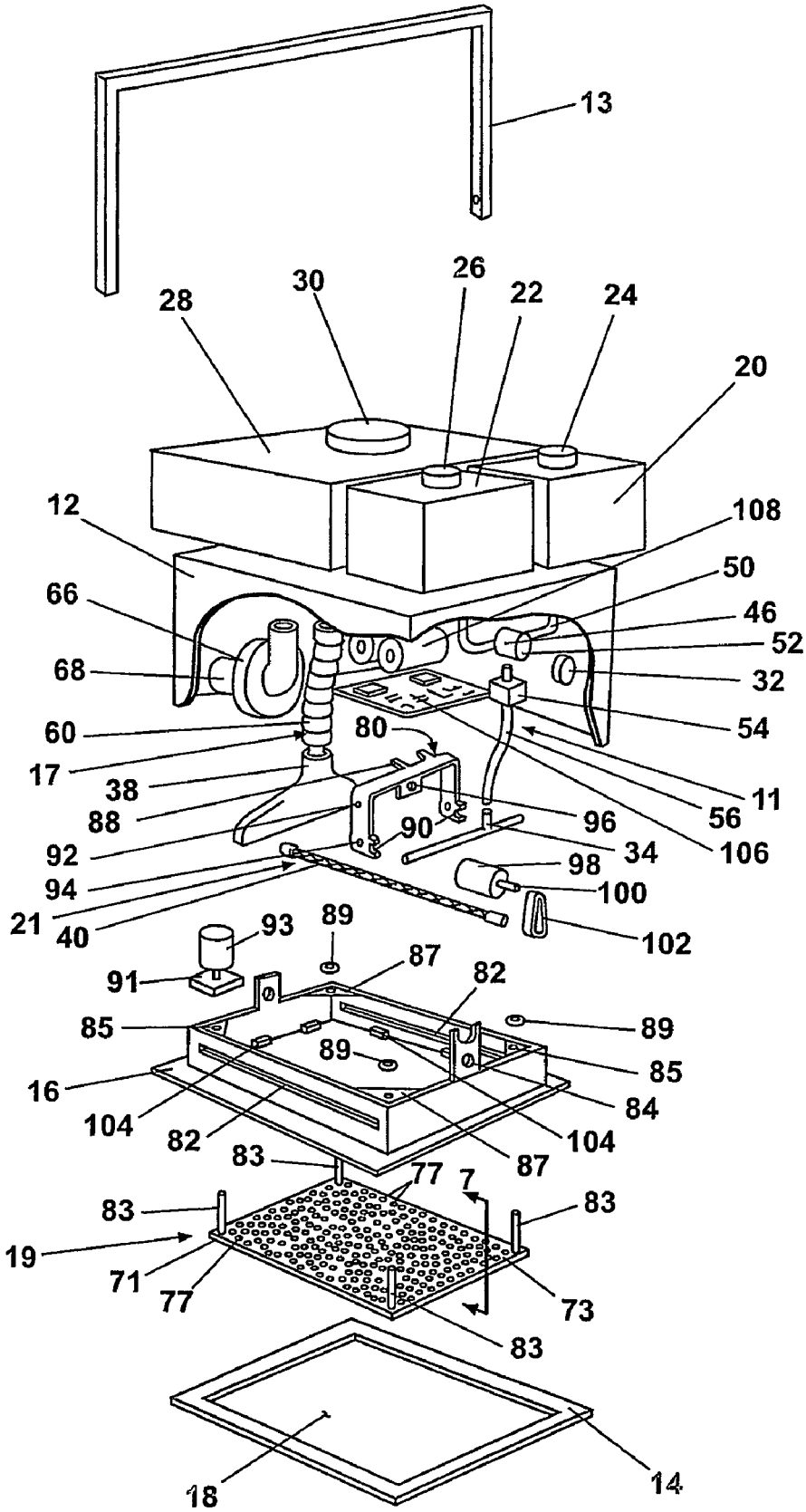
FIG. 6 is an exploded view similar to FIG. 5 of a second embodiment of an unattended spot cleaning apparatus according to the invention with a vibrating platen.
Figure 7:
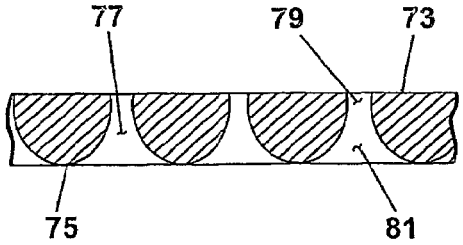
FIG. 7 is a sectional view of the vibrating platen taken along line 7—7 of FIG. 6.
Figure 8:
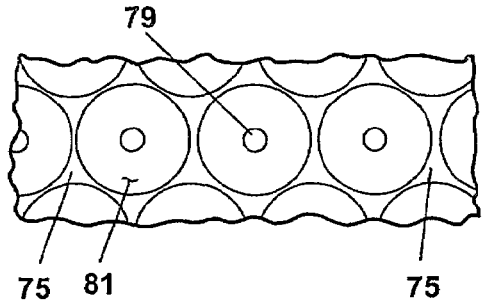
FIG. 8 is a partial bottom view of the vibrating platen shown in FIG. 6.

Referring to FIGS. 6, 7, and 8, in a third embodiment, the agitation system 19 can be a perforated vibrating platen. A plate 71 comprises a top surface 73, a bottom surface 75, and a plurality of apertures 77 therethrough creating a perforated structure in constant contact with the surface to be cleaned within cleaning aperture 18. Referring to FIG. 8, the apertures 77 comprise a smaller opening 79 on the top surface 73 and a larger opening 81 on the bottom surface 75 oriented in a concentric fashion. Referring to FIG. 7, the concentric openings 73 and 75 are joined by an arcuate wall to create a bugle-shaped opening 77 through the plate 71. The larger openings 81 are located directly adjacent one another in order to minimize the bottom surface 75 and maximize the surface area of larger opening 81 in direct contact with the surface to be cleaned. The openings 77, therefore, create a plurality of smaller suction nozzles spaced across the plate 71. A vertical support rod 83 is fixedly attached to the top surface 73 in each of the four corners on the top surface 73 of the plate 71. Each vertical support rod 83 corresponds to a guide aperture 85 formed through a support bracket 87 affixed to an upper inside wall of the rack support structure 16. Three of the vertical support rods 83 are covered with a retaining cap 89 that moveably secures the plate 71 to the rack support structure 16. The fourth support rod 83 is fixedly attached to a transmission 91. The transmission 91 is movably attached to a motor shaft, which in turn is affixed to a plate motor 93. The plate motor 93 is fixedly attached to an upper surface of the rack support structure 16. The transmission 91 converts rotational motion of the motor shaft into lateral motion by the plate 71. High frequency vibrations are transmitted through the plate 71 to the surface to be cleaned resulting in debris separating from the surface. Loose debris is then removed by the fluid recovery system by creating suction above the plate 71 and through the bugle-shaped apertures 73 as previously described. In one embodiment, the high frequency vibrations are ultrasonic.

Figure 9:
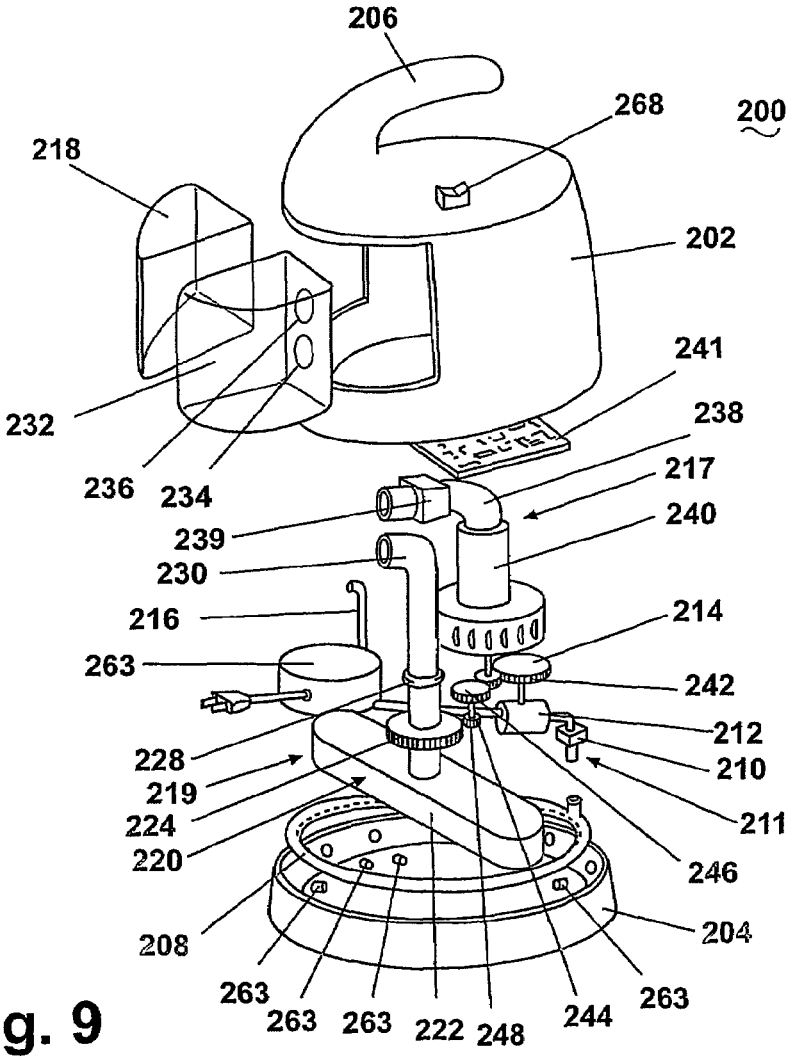
FIG. 9 is an exploded view of a third embodiment of an unattended spot cleaning apparatus according to the invention.

In a fourth embodiment, the agitation system 19 is a sonic system that removes debris by directing sound waves to the surface to be cleaned at a specified frequency as disclosed in U.S. Pat. No. 3,609,787 to Aurelio et al., which is incorporated herein by reference in its entirety. The sound waves create vibrations that separate debris from the surface to be cleaned. The loosened debris can be removed as previously described. Referring to FIG. 9, in a fifth embodiment the unattended spot cleaner 200 further comprises an enclosure 202, a base 204, a fluid distribution system 211, a fluid recovery system 217 and an agitation system 219. The enclosure 202 further comprises a recess that accepts both the fluid tank 218, and the recovery tank 232. The enclosure 202 further comprises a handgrip 206 located on an upper portion of the enclosure 202. The enclosure 202 is preferably made of a transparent or translucent material so that the area within the enclosure 202 is visible to the user from outside the unattended spot cleaner 200.

The fluid distribution system 217 further comprises a spray manifold 208, a solenoid valve 210, a pump 212, a pump gear 214, a fluid conduit 216, and the fluid tank 218. All of the components in the fluid distribution system are fluidly connected. The pump gear 214 meshes with a corresponding pinion gear 242 on a shaft extending from a fan motor assembly 240. The pump gear 214 corresponds with the pump 212 via a shaft. The solenoid valve 210 is electrically connected to the controller 241 for selectively distributing fluid to the spray manifold 208 as previously described in the first embodiment.

The fluid recovery system 217 further comprises a nozzle brush assembly 220 in fluid communication with a first conduit 222. A nozzle gear 224 is fixedly attached to an exterior surface of the first conduit 222. A sealing slip ring 228 is attached to a second end of the first conduit 222 opposite the nozzle brush assembly 220. The slip ring 228 sealingly mates with a second conduit 230 such that rotating motion between the first conduit 222 and the second conduit 230 can occur but motion along a longitudinal axis of the first conduit 222 and the second conduit 230 is minimized. The second conduit 230 is in fluid communication with the recovery tank 232, specifically at a recovery tank inlet 234 sealingly formed at an aperture through an outer wall of recovery tank 232. A third conduit 238 is in fluid communication with a recovery tank outlet 236 sealingly formed at an aperture through a sidewall of recovery tank 232. The third conduit 238 is in fluid communication with the motor fan assembly 240. A suction solenoid valve 239 selectively blocks airflow through the third conduit 238 on command from a controller 241 as previously described in the first embodiment. A motor shaft extends through a fan portion of motor fan assembly 240 and further comprises a motor pinion gear 242. A gear reduction assembly comprises a shaft 244 upon which a first reduction gear 246 is attached to one end of shaft 244 and a second reduction gear 248 is attached to the other end of shaft 244. In the assembly, the motor pinion gear 242 is in constant communication with the first reduction gear 246 and the second reduction gear 248 is in constant communication with the nozzle gear 244.

Figure 10:
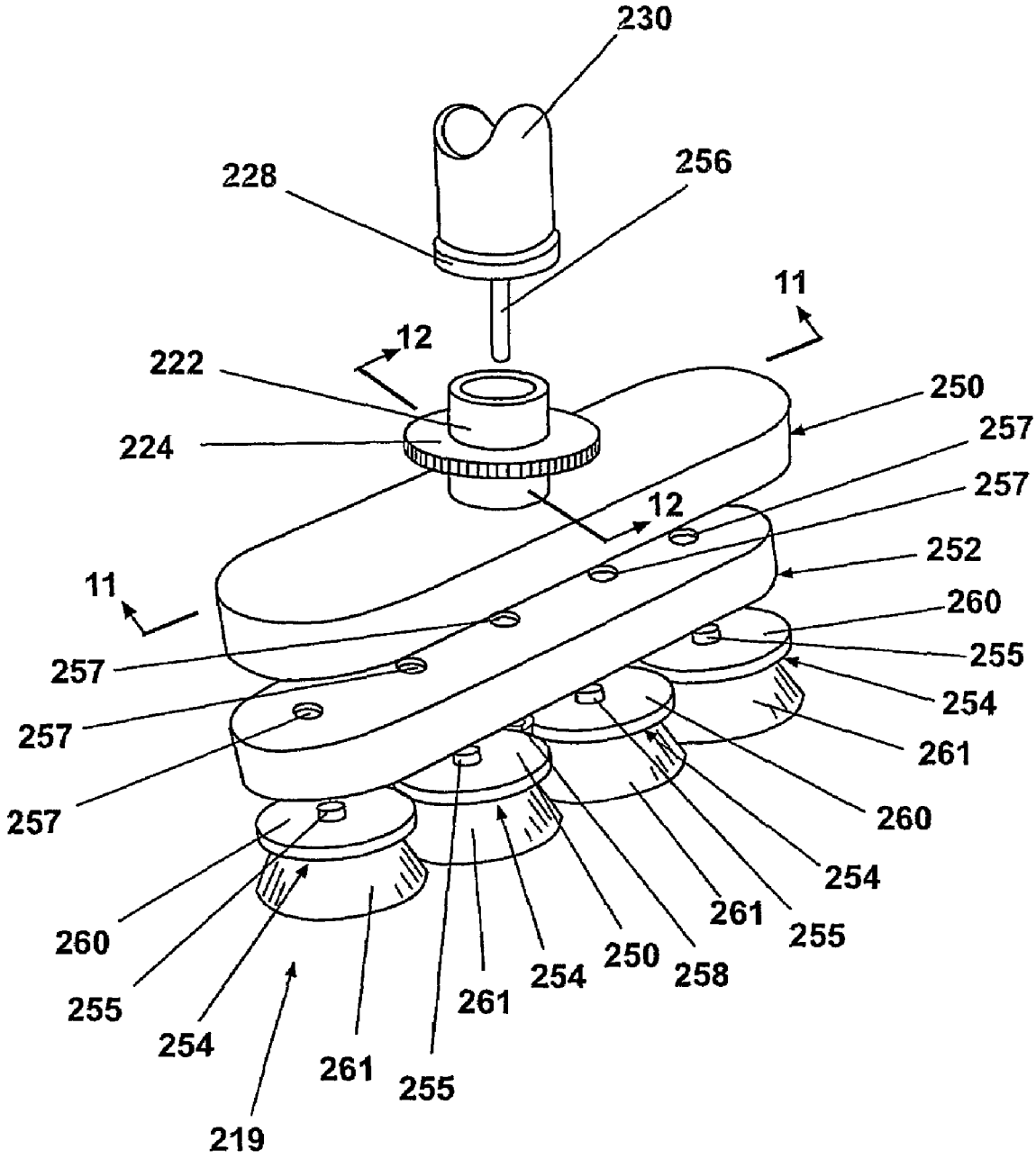
FIG. 10 is an exploded view of a nozzle brush assembly of the unattended spot cleaning apparatus shown in FIG. 9.
Figure 11:
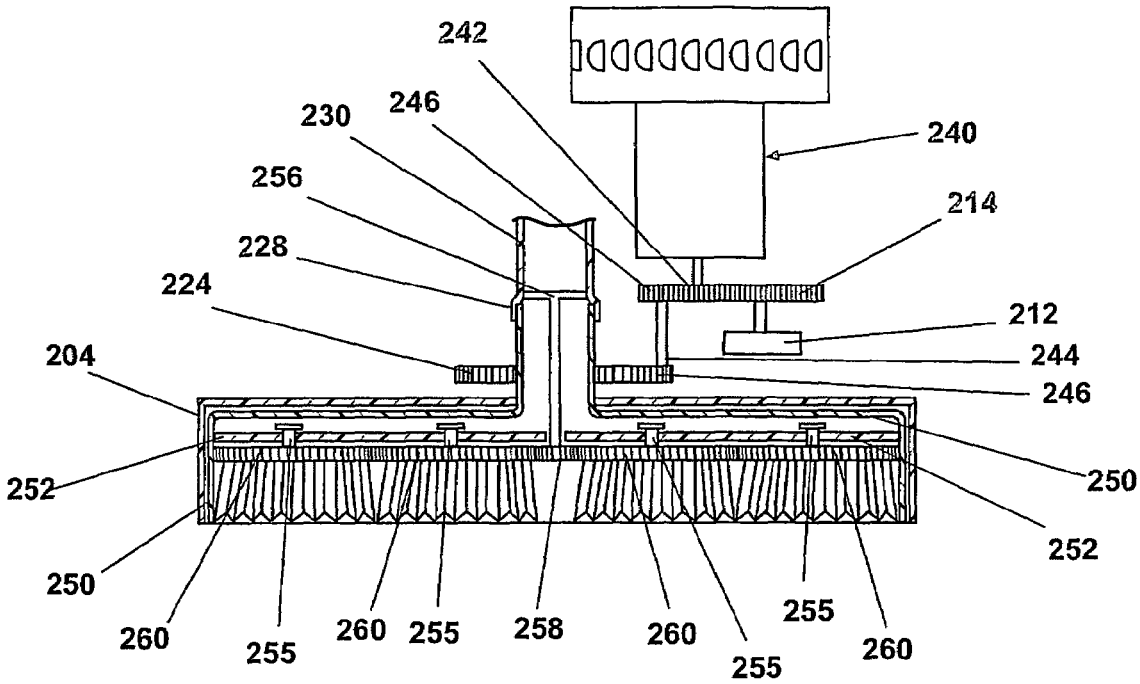
FIG. 11 is a partial sectional view taken along line 11—11 of FIG. 10.
Figure 12:
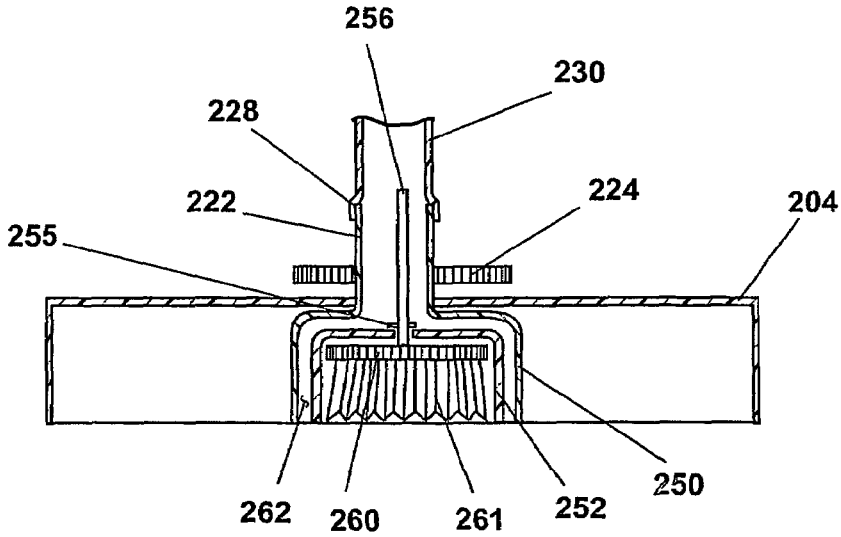
FIG. 12 is a partial sectional view taken along line 12—12 of FIG. 10.

Referring to FIGS. 10 and 11, the nozzle brush assembly 220 further comprises a nozzle housing 250, a brush housing 252, and a plurality of bristle brushes 254. A T-shaped brush drive shaft 256 is fixedly attached to an inner surface of the second conduit 230 and extends through the first conduit 222, the nozzle housing 250 and the brush housing 252. A drive gear 258 is fixedly attached to the opposite end of the shaft 256 and further comprises a plurality of teeth on the outer perimeter thereof. The bristle brush 254 further comprises a brush gear 260, a centrally located protrusion 255 on an upper face of the brush gear 260 and a plurality of bristles 261 attached to a lower surface of the brush gear 260. The protrusions 255 on the brush gear 260 extend through corresponding apertures 257 in the brush housing 252 and are staked, capped, or otherwise suitably attached to the brush housing 252 so that the bristle brush 254 is captured by the brush housing 252 and is allowed to rotate freely within aperture 257. The bristle brushes 254 are spaced along the brush housing 252 so that the brush gears 260 remain in contact and intermesh with one another. The drive gear 258 is stationary and also intermeshes with the brush gear 260 of the inner most bristle brushes 254.

Figure 13:
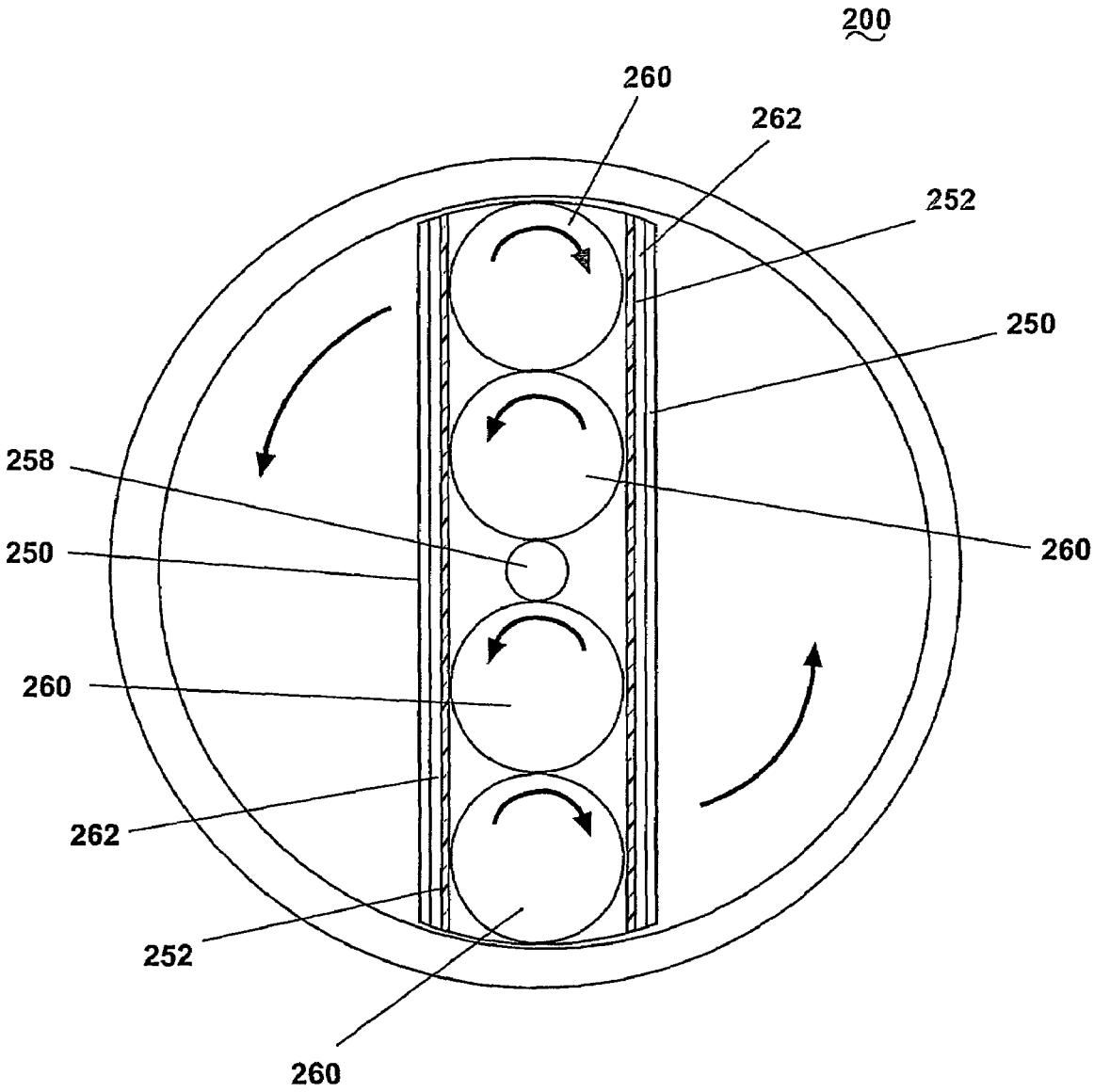
FIG. 13 is a bottom plan view of the unattended spot cleaning apparatus shown in FIG. 9.

The nozzle housing 250 nests over the brush housing 252 such that an inner wall of the nozzle housing 250 remains in spaced relation to an outer wall of the brush housing 252 thus creates a suction nozzle plenum 262. The suction nozzle plenum 262 is in fluid communication with an inner surface of the first conduit 222 forming a part of a working air conduit that is in fluid communication with the motor fan assembly 240. Referring to FIGS. 11 and 13, when power is applied to the motor fan assembly 240 the motor shaft rotates causing the motor pinion 242 to rotate. The motor pinion 242 is intermeshed with gear teeth of the first reduction gear 246 that in turn causes the second reduction gear 248 to rotate via the shaft 244. The gear teeth of the second reduction gear 248 intermesh with the gear teeth of the nozzle gear 224. Since the nozzle gear 224 is fixedly attached to the first conduit 222 and the first conduit 222 is fixedly attached to the nozzle housing 250, the entire nozzle brush assembly 220 rotates about an axis formed by the brush drive shaft 256. Since the brush drive shaft 256 and the drive gear 258 are fixed, the inner brush gears 260 that intermesh with the drive gear 258 are also caused to rotate. Intermeshing of the outer brush gears 260 with the inner brush gears 260 create a counter rotation as more clearly shown in FIG. 13 by arrows. Thus, as the nozzle brush assembly 220 rotates in a counterclockwise direction, the inner brush gears 260 are caused to rotate in counterclockwise direction and the outer brush gears 260 are caused to rotate in clockwise direction.

Referring again to FIG. 9, a plurality of floor condition sensors 263 are mounted to an interior surface of the base 204 and operate in the same manner as described for the preferred invention. A cord reel assembly 264 is mounted within the enclosure 202 and further comprises a spring-loaded reel that retracts a power cord about an internal drum. The power cord interfaces with facility electrical outlet and provides electrical power to a switch 268 located on an upper surface of the enclosure 202. The switch 268 interrupts power to the controller 241. The controller 241 operates as previously described in the first embodiment.

Figure 14:
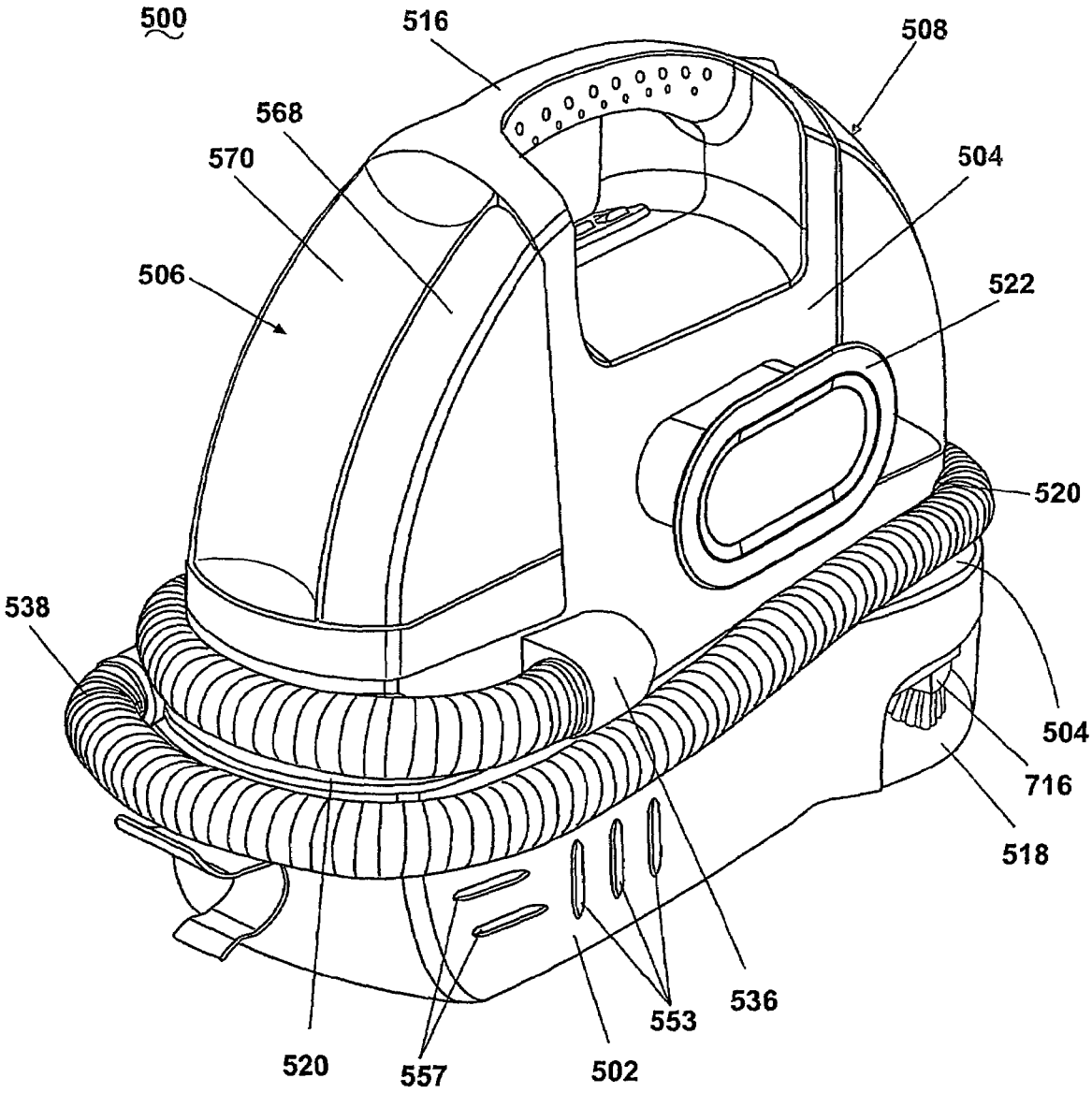
FIG. 14 is a rear perspective view of a sixth embodiment of an unattended spot cleaning apparatus according to the invention.
Figure 15:
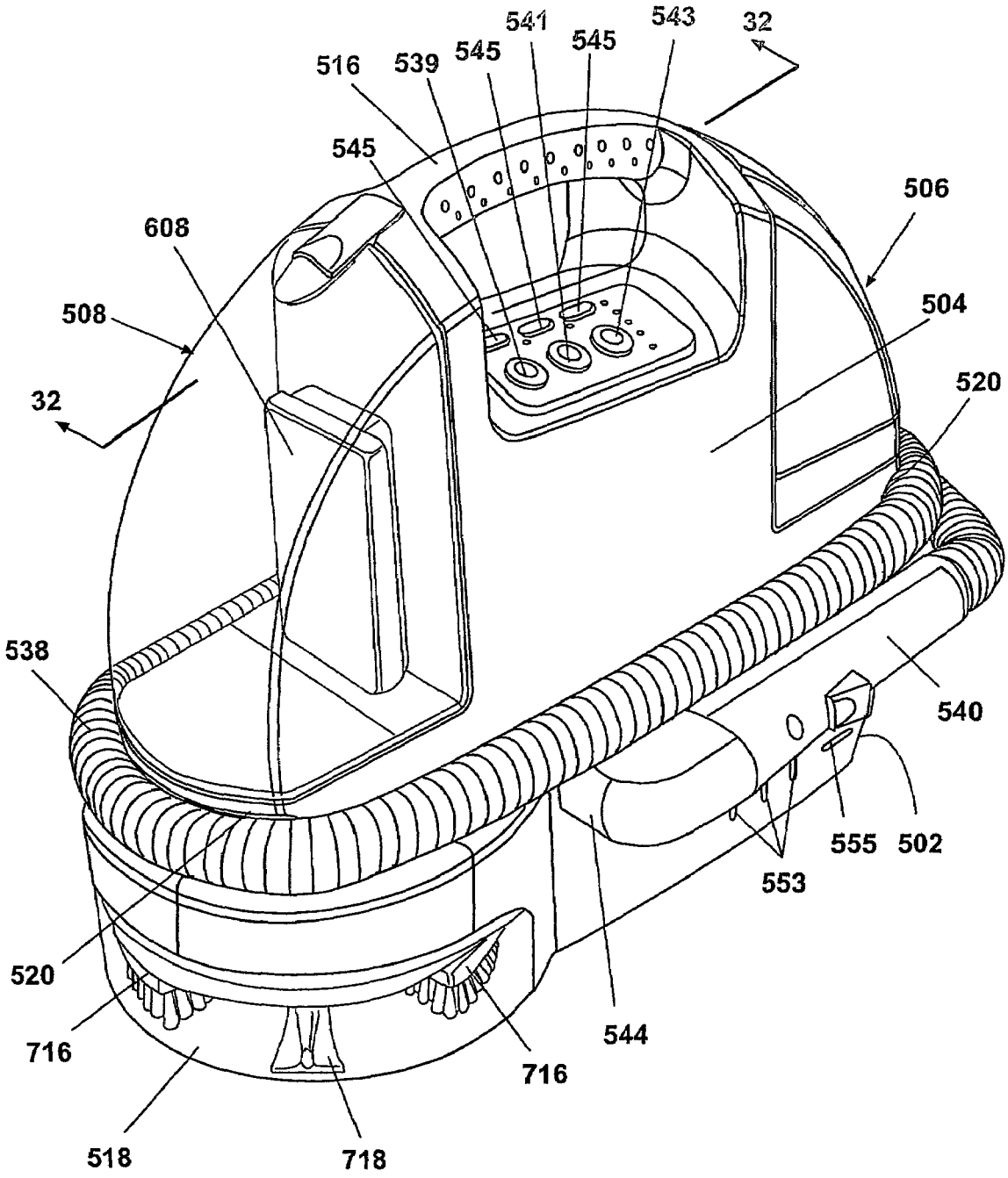
FIG. 15 is a front perspective view of the unattended spot cleaning apparatus shown in FIG. 14.
Figure 16:
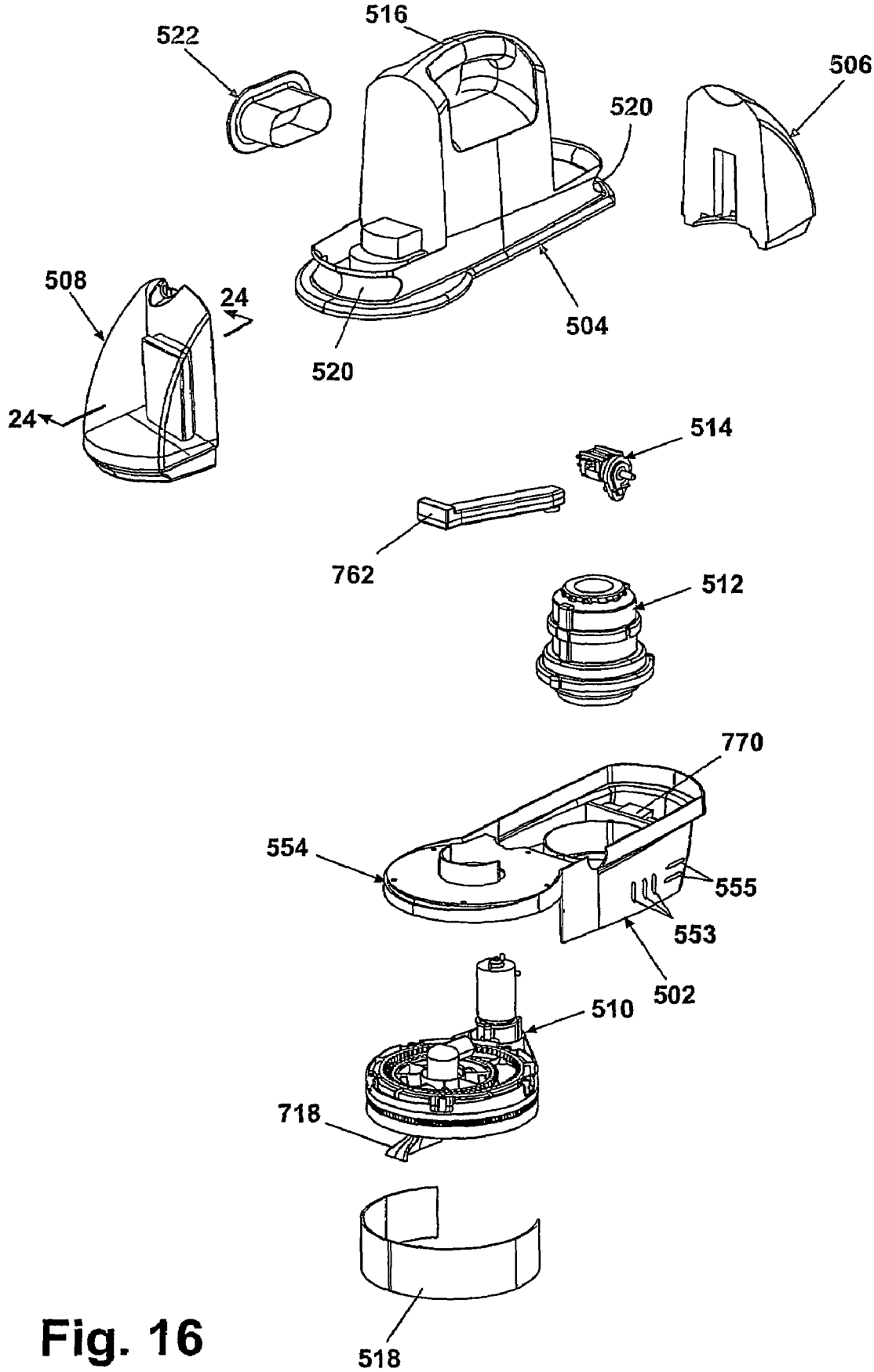
FIG. 16 is an exploded view of the unattended spot cleaning apparatus shown in FIG. 14.

A sixth embodiment of a spot cleaning apparatus 500 for unattended or manual cleaning of spots and stains on carpeted surfaces according to the invention is illustrated in FIGS. 14–30. Referring particularly to FIGS. 14–16, the spot cleaning apparatus 500 comprises a bottom housing or portion 502, a top housing or portion 504, a clean tank assembly 506, a recovery tank assembly 508, a carriage assembly 510, a motor/fan assembly 512, and a pump assembly 514 The bottom housing 502 rests on a surface to be cleaned, and the top housing 504 and the bottom housing 502 mate to form a cavity therebetween. A handle 516 is integrally formed at an upper surface of the top housing 504 to facilitate easy carrying of the spot cleaning apparatus 500. A carriage assembly lens 518 is attached to a forward lower section of the bottom housing 502 to define an opening in the underside of the bottom housing 502 and is preferably made from a transparent material for visibility of the carriage assembly 510 located behind the carriage assembly lens 518. Hose recesses 520 are integrally formed in a lower surface of the top housing 504 in forward and rearward locations. For explanatory purposes, the forward direction of the spot cleaning apparatus 500 is defined by the location of the carriage assembly 510 and the carriage assembly lens 518. The rearward direction is opposite of the forward direction.

Figure 18:
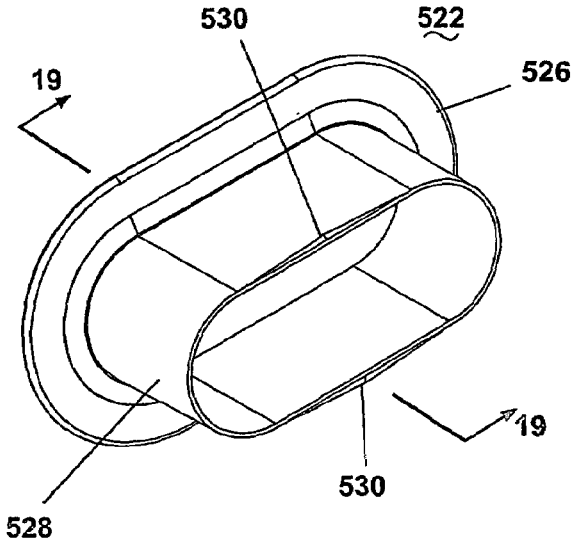
FIG. 18 is a perspective view of a cord wrap of the unattended spot cleaning apparatus shown in FIG. 14.
Figure 19:
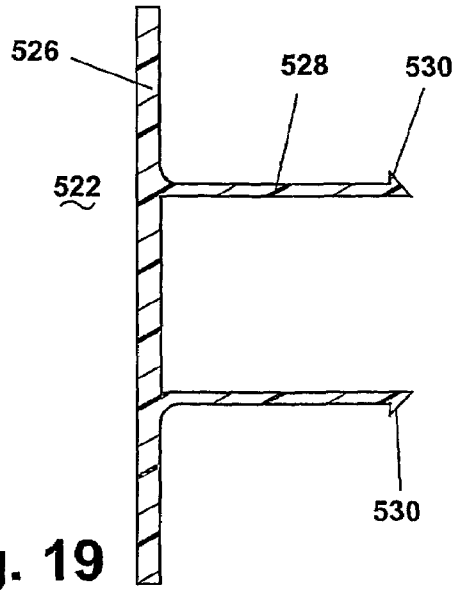
FIG. 19 is a sectional view of the cord wrap taken along line 19—19 of FIG. 18.
Figure 20:
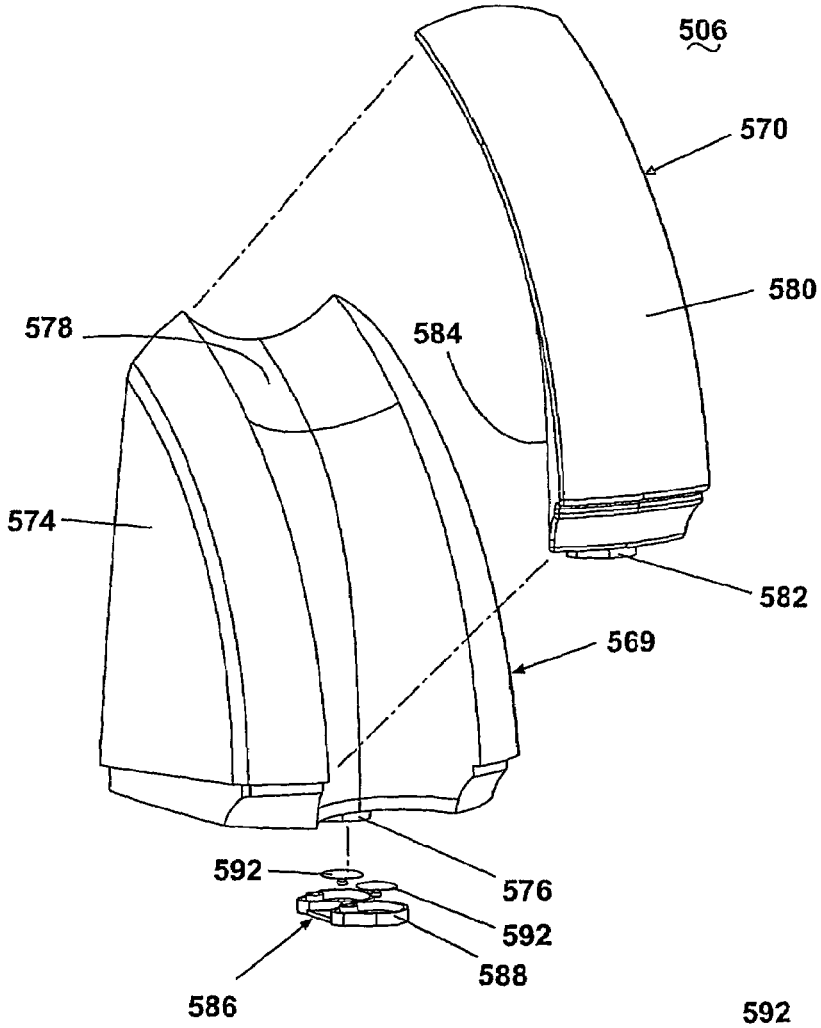
FIG. 20 is an exploded view of a clean tank assembly of the unattended spot cleaning apparatus shown in FIG. 14.
Figure 21:
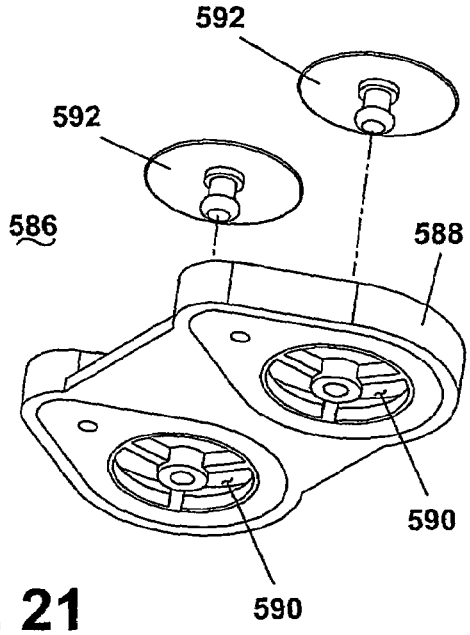
FIG. 21 is a perspective view of a cap assembly from the clean tank assembly shown in FIG. 20.

Referring to FIGS. 16, 18, and 19, a cord wrap 522 is slidably mounted to a side surface of the top housing 504 and, in an extended position, supports a power cord (not shown) for easy storage thereof The cord wrap 522 comprises an outer flange 526 and a generally elongated support tube 528. The support tube 528 comprises one or more engagement detents 530 on an end opposite the outer flange 526. The cord wrap 522 is mounted in a cord wrap aperture (not shown) in a side wall of the top housing 504. To insert the cord wrap 522 into the cord wrap aperture, the support tube 528 is sufficiently deflected such that the engagement detents can pass through the cord wrap aperture 532. Once the engagement detents 530 clear the cord wrap aperture, the support tube 528 returns to its original shape, and the engagement detents 530 contact an inner surface of the top housing 504 to retain the cord wrap 522 therein. The cord wrap extends laterally from the top housing 504, and the support tube 528 provides a surface upon which the power cord can be wrapped. The power cord is mounted to the top housing 504 with a conventional strain relief device. When the spot cleaning apparatus 500 is in use, the power cord is unwrapped from the cord wrap 522, and its free end is inserted into or otherwise coupled with a conventional power outlet. With the power cord removed, the cord wrap 522 can be pushed in toward the top housing 504 to a retracted position wherein the outer flange 526 abuts the top enclosure 504 to thereby effectively conceal the cord wrap 522 for aesthetic purposes.

In an alternate embodiment, a pocket is formed around the cord wrap aperture such that the cord wrap 522 with the power cord wrapped thereon can be pushed into the top housing 504 to achieve a clean, flush appearance for the spot cleaning apparatus 500 when not in use.

Figure 33:
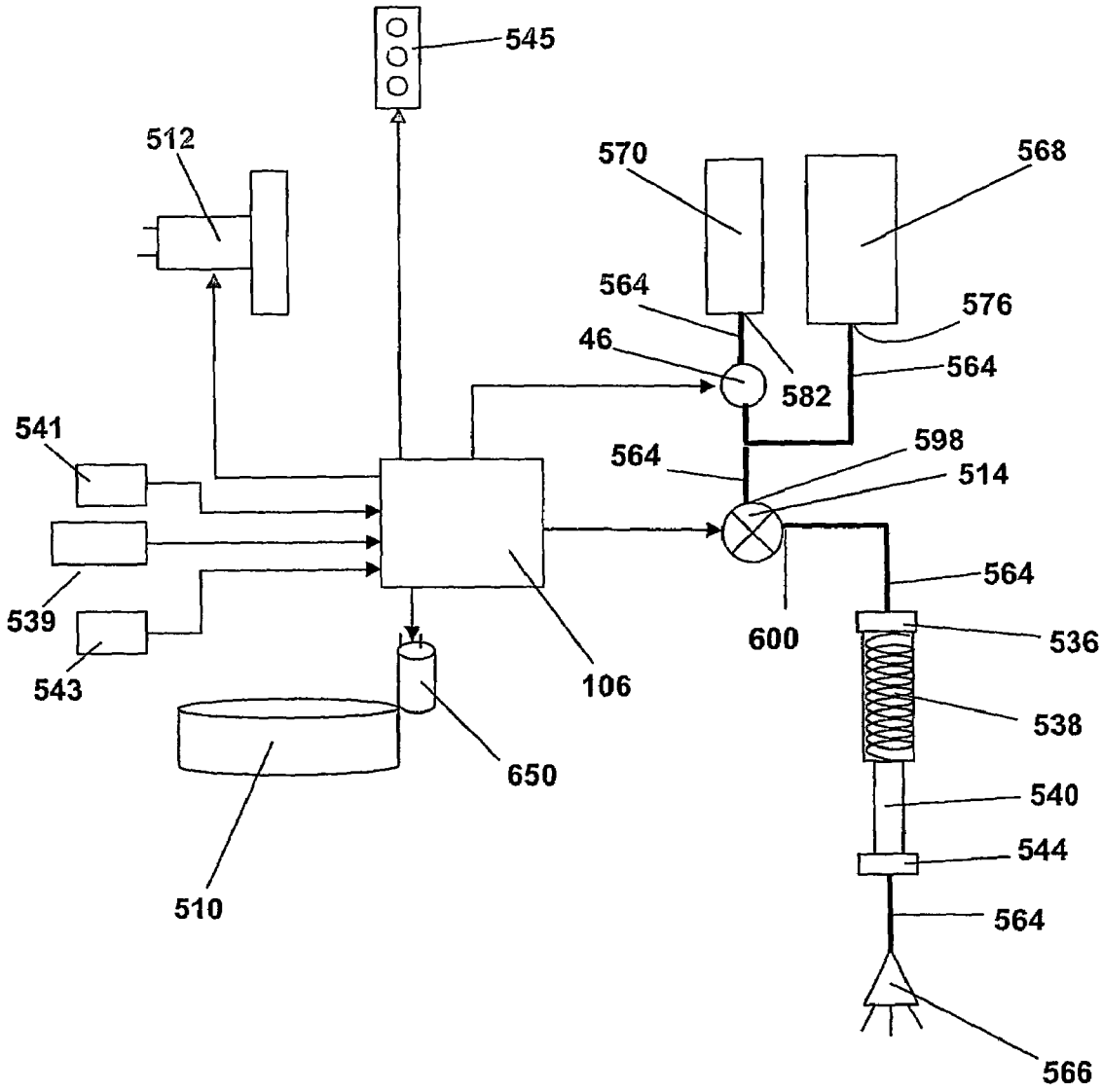
FIG. 33 is a schematic view of a logic circuit of the unattended spot cleaning apparatus shown in FIG. 14.

Referring to FIG. 15, a control panel 537 comprises a bezel to retain a first operational mode switch 539, a second operational mode switch 541, a manual switch 543, and a plurality of corresponding indicator lights 545 that visually communicate the operational mode of the spot cleaning apparatus 500 to the user. In use, the user selects the desired operational mode by engaging the appropriate switch 539, 541, or 543, which thereby sends an appropriate signal to the controller 106. The controller 106 then sends appropriate output signals to components of the spot cleaning apparatus 500, as indicated in FIG. 33, as well as a signal to the appropriate indicator light 545 to communicate the operational mode to the user.

The top housing 504 further comprises a suction hose assembly that can be detached at one end from the spot cleaning apparatus for cleaning in a manual mode or attached to the spot cleaning apparatus at both ends during an automatic mode. The suction hose assembly comprises a suction hose fitting 536 preferably located on the same side as the cord wrap 522. A flexible suction hose 538 is fixedly attached to and is in fluid communication with the suction hose fitting 536 via a commonly known connector. A suction hose grip 540 is fixedly attached to an opposite end of the flexible suction hose 538. A suitable suction hose assembly is disclosed in U.S. patent application Ser. No. 10/065,891 to Lenkiewicz, which is incorporated herein by reference in its entirety. A hose grip fitting 544 is fixedly attached between the top housing 504 and the bottom housing 502 to removably retain the hose grip 540 to the spot cleaning apparatus 500. Various cleaning attachments can be removably mounted to the hand grip 540 to manually perform specialized cleaning tasks in addition to or separate from the automatic unattended function of the spot cleaning apparatus 500. When the suction hose 538 is not utilized (i.e. during an automatic mode), it can be wrapped around the top housing 504 so that the hose 538 rests in the hose recesses 520 and the hose grip 540 is retained by the hose grip support.

Figure 17:
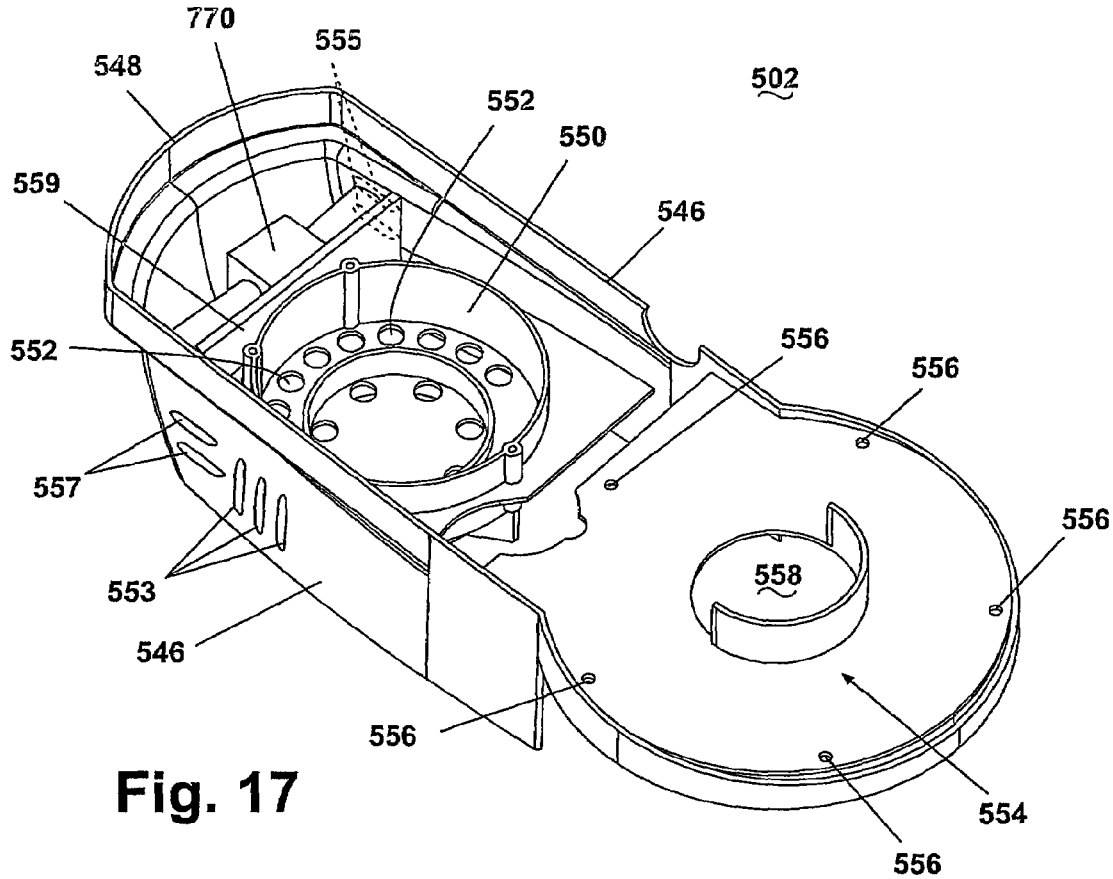
FIG. 17 is a perspective view of a bottom housing of the unattended spot cleaning apparatus shown in FIG. 14.

Referring now to FIG. 17, the bottom housing 502 is a generally box-like structure comprising a pair of generally vertical spaced side walls 546 connected by a slightly arcuate rear wall 548 to form a space therebetween. The bottom housing 502 further comprises a motor/fan support 550 between the side walls 546 and upon which the motor/fan assembly 512 rests. The motor/fan support 550 comprises a plurality of apertures 552 therethrough to facilitate flow of exhaust and cooling air for the motor/fan assembly 512. Exhaust and cooling air exits the spot cleaning apparatus 500 through a plurality of motor exhaust apertures 553 formed in the side walls 564 and in fluid communication with the apertures 552. A plurality of ion inlet apertures 555 are located on one side wall 546 while a plurality of ion outlet apertures 557 are located on the opposite side wall 546. The motor exhaust apertures 552 are physically separated from the ion apertures 555, 557 by an ion generator wall 559 to prevent mingling of the motor exhaust air and the ionized air. The motor/fan assembly 512 working air path and cooling air path are formed in a fashion similar to that disclosed in U.S. patent application Ser. No. 10/065,891 to Lenkiewicz. A platform-like carriage assembly support 554 is joined to upper edges of the side walls 546 and extends forwardly of the motor/fan support 550. The carriage assembly support 550 comprises a plurality of mounting apertures 556 to secure the carriage assembly 510 thereon. A central working air aperture 558 extends through the carriage assembly support 554.

Referring to FIGS. 14–16, 20–22, and 33, a fluid delivery system comprises the clean tank assembly 506, a pump assembly 514, various fluid supply conduits 564, and at least one fluid distribution member 566. The clean tank assembly 506 comprises a first fluid tank assembly 568, a second fluid tank assembly 570, and a clean tank cap assembly 586. The first fluid tank assembly 568 comprises a blow molded fluid tank 574 with a single outlet aperture 576 disposed on a bottom surface thereof. The first fluid tank 574 defines a cavity for storing a first fluid. A recess 578 is formed in one surface of the first fluid tank 574 for nestingly receiving the second fluid tank assembly 570. The recess 578 and the second fluid tank assembly 570 are dimensioned such that the assembled fluid tank assemblies 568, 570 have the appearance of a single unit with a smooth, uniform outer surface. The second fluid tank assembly 570 comprises a blow molded second fluid tank 580 with a single outlet aperture 582 disposed on a bottom surface thereof similar to the first fluid 574. The second fluid tank 580 comprises a protruding rear wall 584 that nestingly mates with the recess 578 on the first fluid tank 574. The second fluid tank 580 defines a cavity for storing a second fluid. Both outlet apertures 576, 582 are sealingly covered by the cap assembly 586.

In the preferred embodiment, the cap assembly 586 is a single cap frame 588 with at least two cap apertures 590 corresponding to the outlet apertures 576, 582. A commonly known umbrella valve 592 selectively seals the cap apertures 590. Desired mixing ratios between the the first fluid drawn from the first fluid tank assembly 568 and the second fluid drawn from the second fluid tank assembly 570 are determined by the orifice size of the apertures 590. When the spot cleaning apparatus 500 includes a mixing valve 46, as described in the first embodiment, ratio of fluid mixtures can range from 100/0 first fluid/second fluid to 0/100 first fluid/second fluid. The preferred ratio of the first fluid from the first fluid tank assembly 568 to the second fluid from the second fluid tank assembly 570 is 80/20. Preferably, the first fluid is a 4% by weight hydrogen peroxide is mixed with 95% by weight distilled water, and the second fluid is a commonly known carpet cleaning detergent. Alternatively, the first fluid is a cleaning solution, such as a commonly known carpet cleaning composition, and the second fluid is a clear fluid, such as water. However, it is within the scope of the invention for the first and second fluids to comprise other types of fluids and for the first fluid to be the same as the second fluid. Optionally, either the first fluid or the second fluid can be distributed without mixing with the other of the first fluid or the second fluid. For example, the first fluid can be distributed without dilution by the second fluid for concentrated cleaning, or the second fluid can be distributed alone for rinsing.

Venting for the first and second fluid tank assemblies 568, 570 can be accomplished in a conventional manner, such as vent holes in an upper surface thereof, or vent tubes can be inserted into the fluid tanks 574, 580 and vented to the atmosphere through the cap assembly 586 in a manner similar to that found in U.S. Pat. No. 6,125,498 to Roberts et al., which is incorporated herein by reference in its entirety.

In the preferred embodiment, the fluid tanks 574, 580 are pre-filled through the outlet apertures 567, 582 with a predetermined amount of the first and second fluids and sealed with the cap assembly 586 to form a captive system wherein the fluid tanks 574, 580 can not be refilled by the user. The clean tank assembly 506 is preferably purchased in this pre-filled state and is disposable when the supply of fluids therein is depleted. Alternatively, the cap assembly 586 can be multiple pieces that correspond to the respective outlet apertures 576, 582 and are removable so that the user can refill the first and second fluid tank assemblies 568, 570 as needed.

Figure 22:
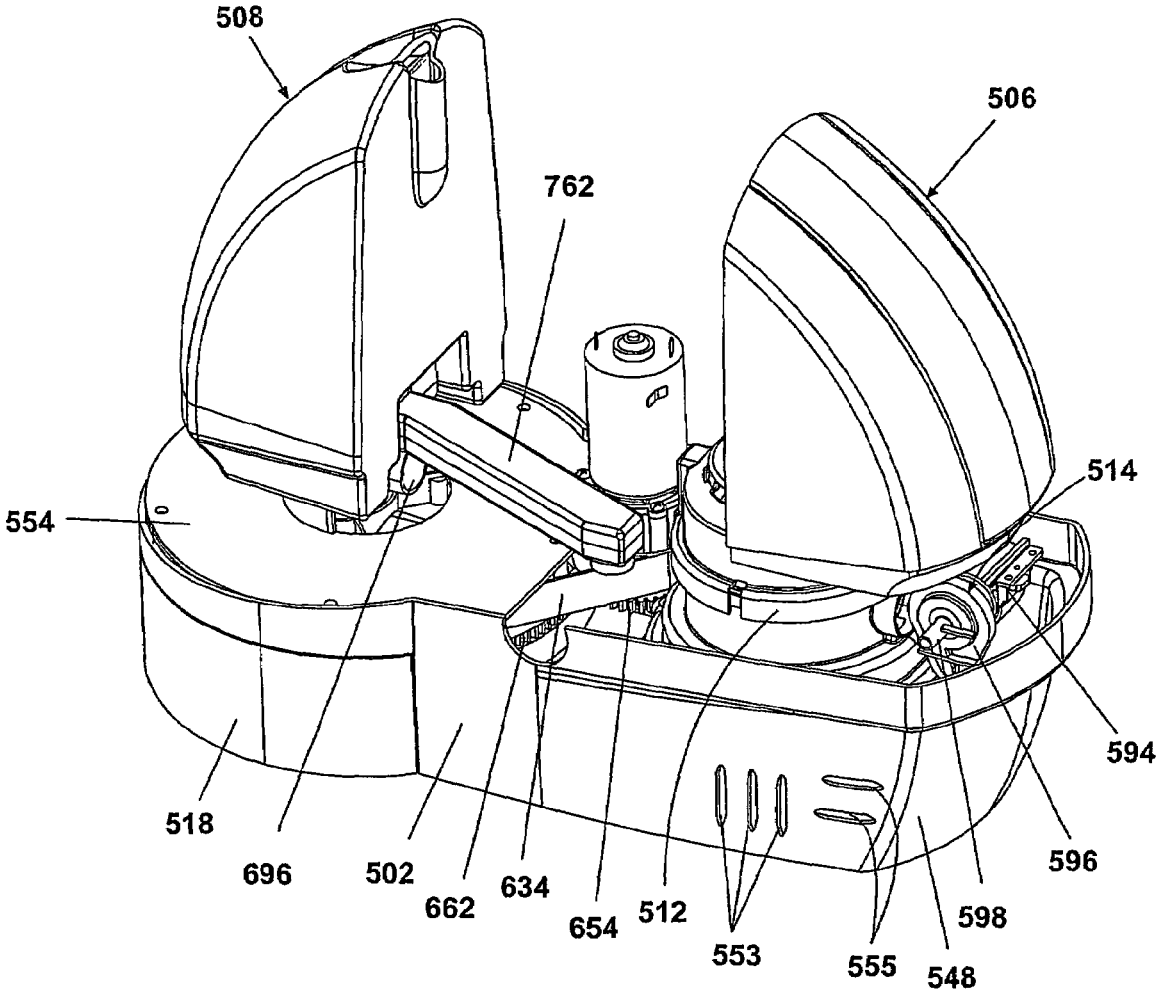
FIG. 22 is a perspective view of the unattended spot cleaning apparatus shown in FIG. 14 with a top housing removed to facilitate viewing of a pump assembly.

Referring to FIGS. 22 and 33, the clean tank assembly 506 is located directly above the pump assembly 514. The pump assembly 514 is mounted to a rear surface of the motor/fan support 550 in the bottom housing 502. The pump assembly 514 comprises an electric motor 594 with a shaft directly coupled to a commonly known mechanical fluid pump 596 similar to that found in the BISSELL Spot Lifter Model 1725 and as disclosed in U.S. Pat. No. 6,125,498 to Roberts, which is incorporated herein by reference in its entirety. The fluid pump 596 comprises a pump inlet 598 and a pump outlet 600. A pair of fluid conduits 564 fluidly communicates the outlet apertures 576, 582 with a common "T" fitting (not shown) on another end. A first fluid conduit 564 fluidly communicates the "T" fitting on one end with the pump inlet 598 on another end. The fluid from the respective tanks 568, 570 mix in the "T" fitting and the first fluid conduit 564 and are drawn into the fluid pump 596, which further mixes the fluids. Mixed fluid is expelled from the fluid pump 596 through the pump outlet 600. A second fluid conduit 564 fluidly communicates the pump outlet 600 with a fluid fitting (not shown) within the suction hose fitting 536. A third fluid conduit (not shown) runs from the fluid fitting and along the length of the suction hose 538. At the end of the suction hose 538, the third fluid conduit is fluidly connected to the grip support fitting 544. When the suction hose grip 540 is coupled to the grip support fitting 544, the third fluid conduit is fluidly connected to a fourth fluid conduit 564 that is connected to the grip support fitting 544 on one end. On the other end, the fourth fluid conduit 564 is connected to the at least one fluid distribution member 566 preferably located underneath the carriage assembly support 554 on the bottom housing 502. At the fluid distribution member 566, the mixed fluid is applied to the surface to be cleaned. In one embodiment, the fluid distribution member 566 is a conventional spray nozzle preferably mounted to the carriage assembly 510. In another embodiment, a fluid conduit terminates above the carriage assembly 510, and fluid drips to the surface to be cleaned. In yet another embodiment, the fluid distribution member 566 is a manifold with spaced openings. When the suction hose grip 540 is removed from the grip support fitting 544, the user can manually apply fluid to the surface to be cleaned. Refer to FIG. 33 for a schematic diagram of the fluid delivery system.

Figure 23:
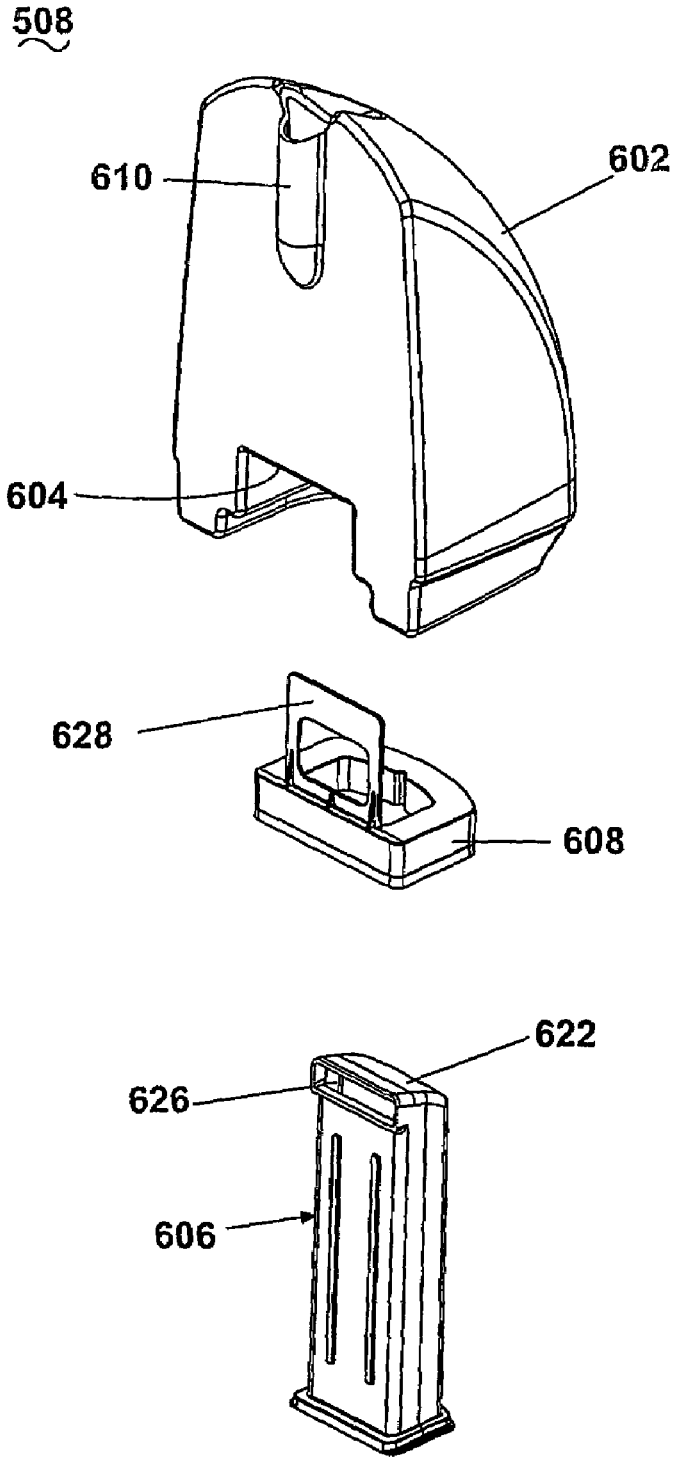
FIG. 23 is an exploded view of a recovery tank assembly of the unattended spot cleaning apparatus shown in FIG. 14.
Figure 24:
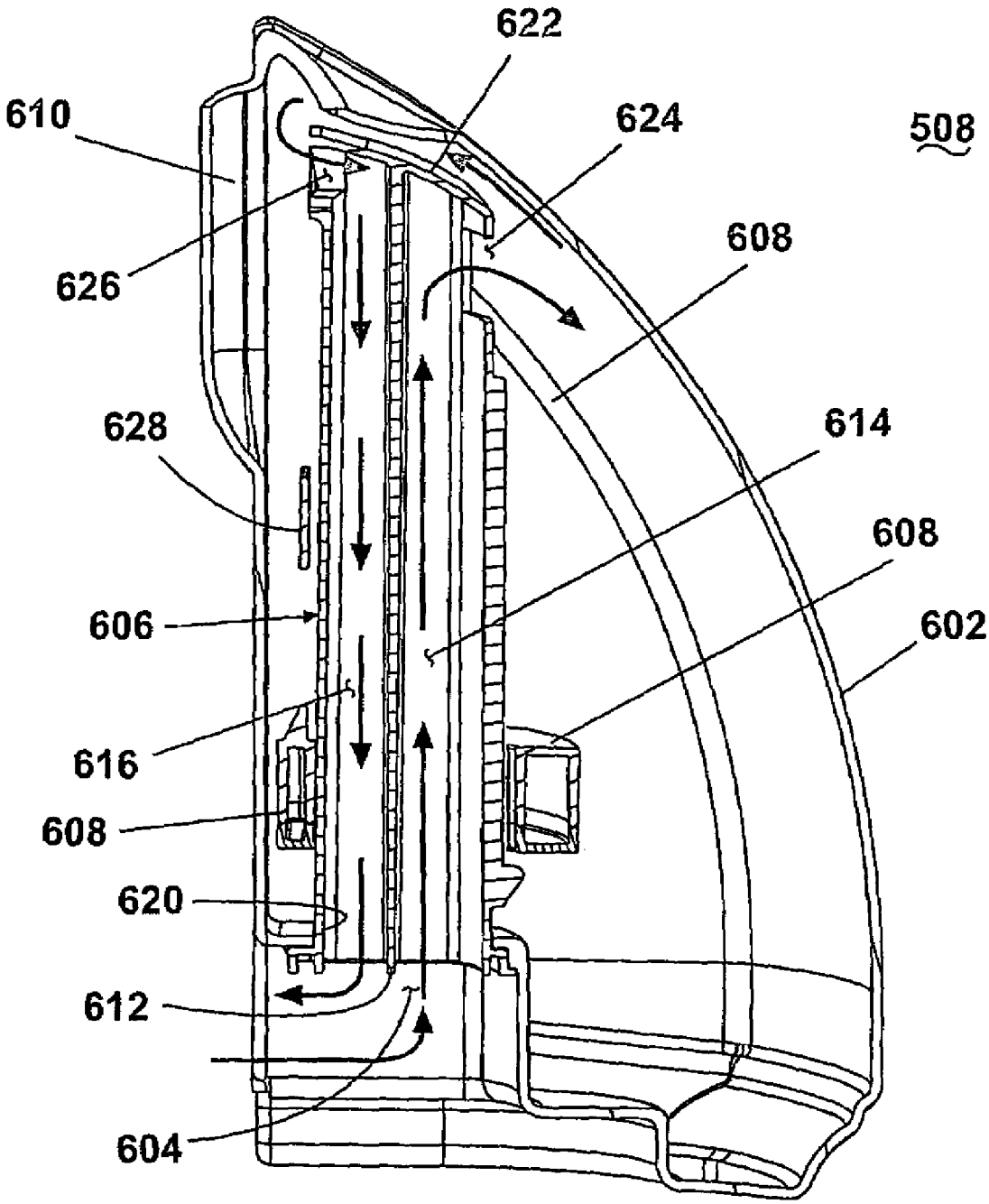
FIG. 24 is a sectional view of the recovery tank assembly taken along line 24—24 of FIG. 23.
Figure 25:
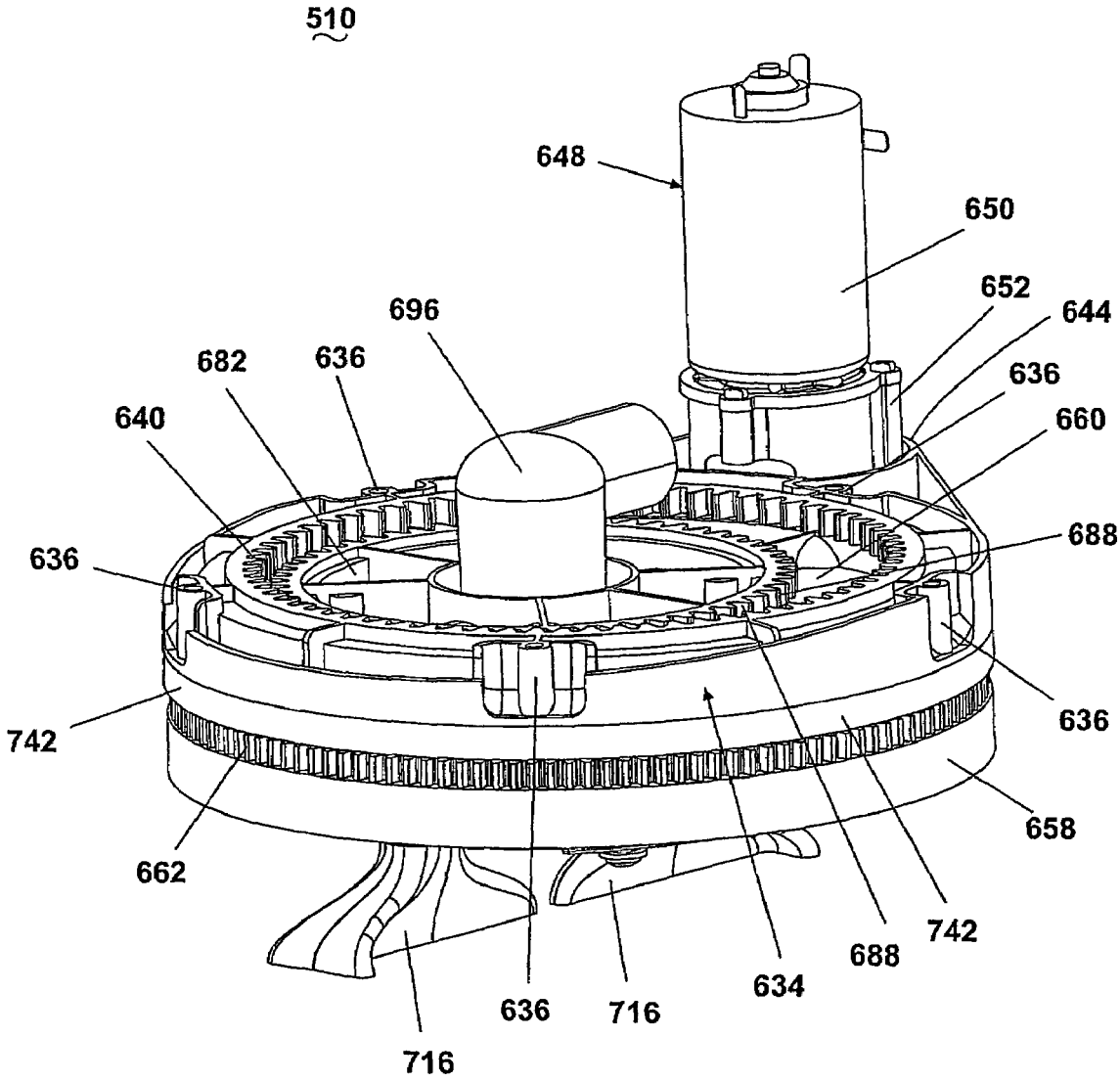
FIG. 25 is a perspective view of a carriage assembly of the unattended spot cleaning apparatus shown in FIG. 16.
Figure 26:
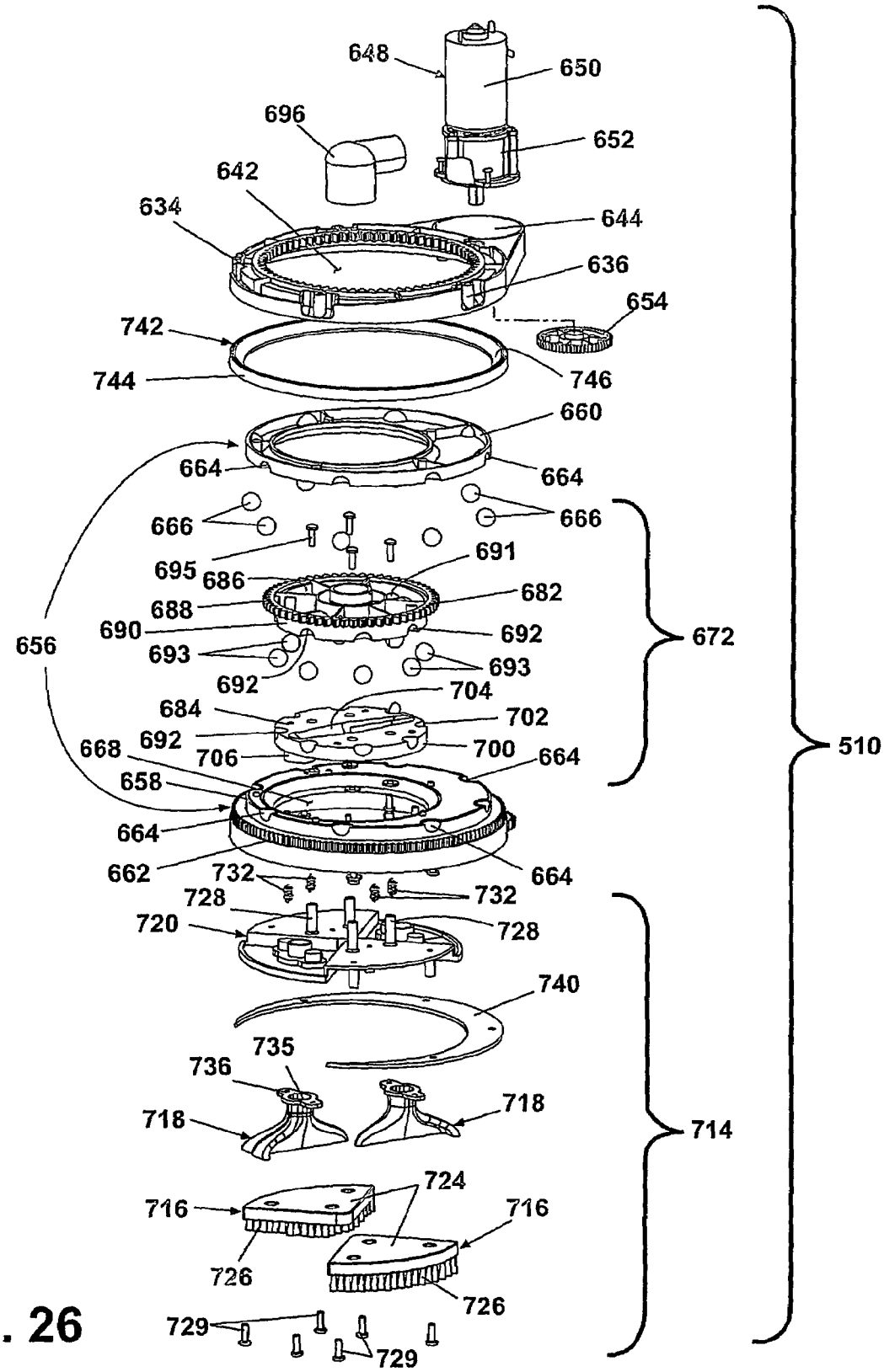
FIG. 26 is an exploded view of the carriage assembly shown in FIG. 25.
Figure 27:
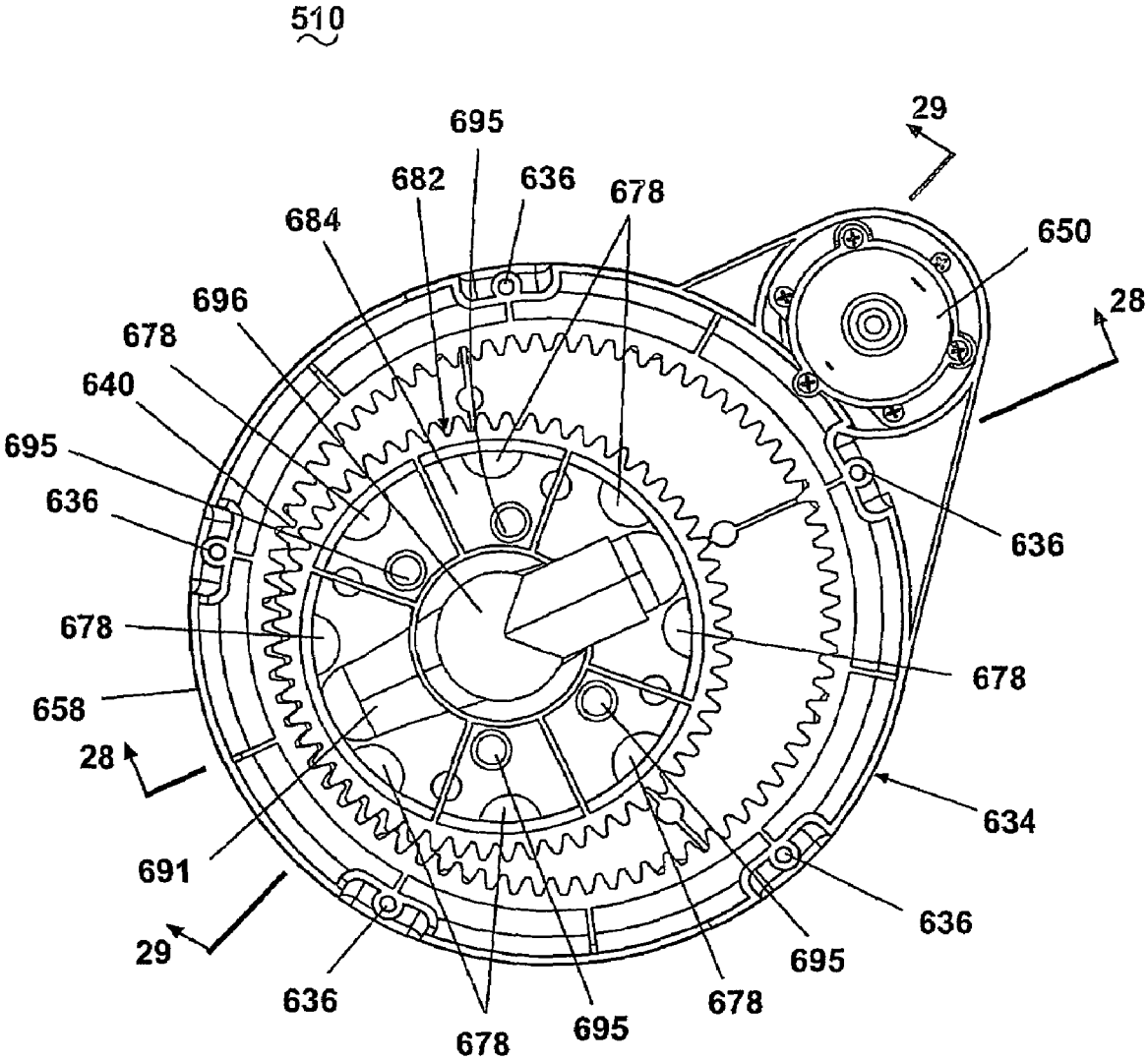
FIG. 27 is a bottom plan view of the carriage assembly shown in FIG. 25.
Figure 28:
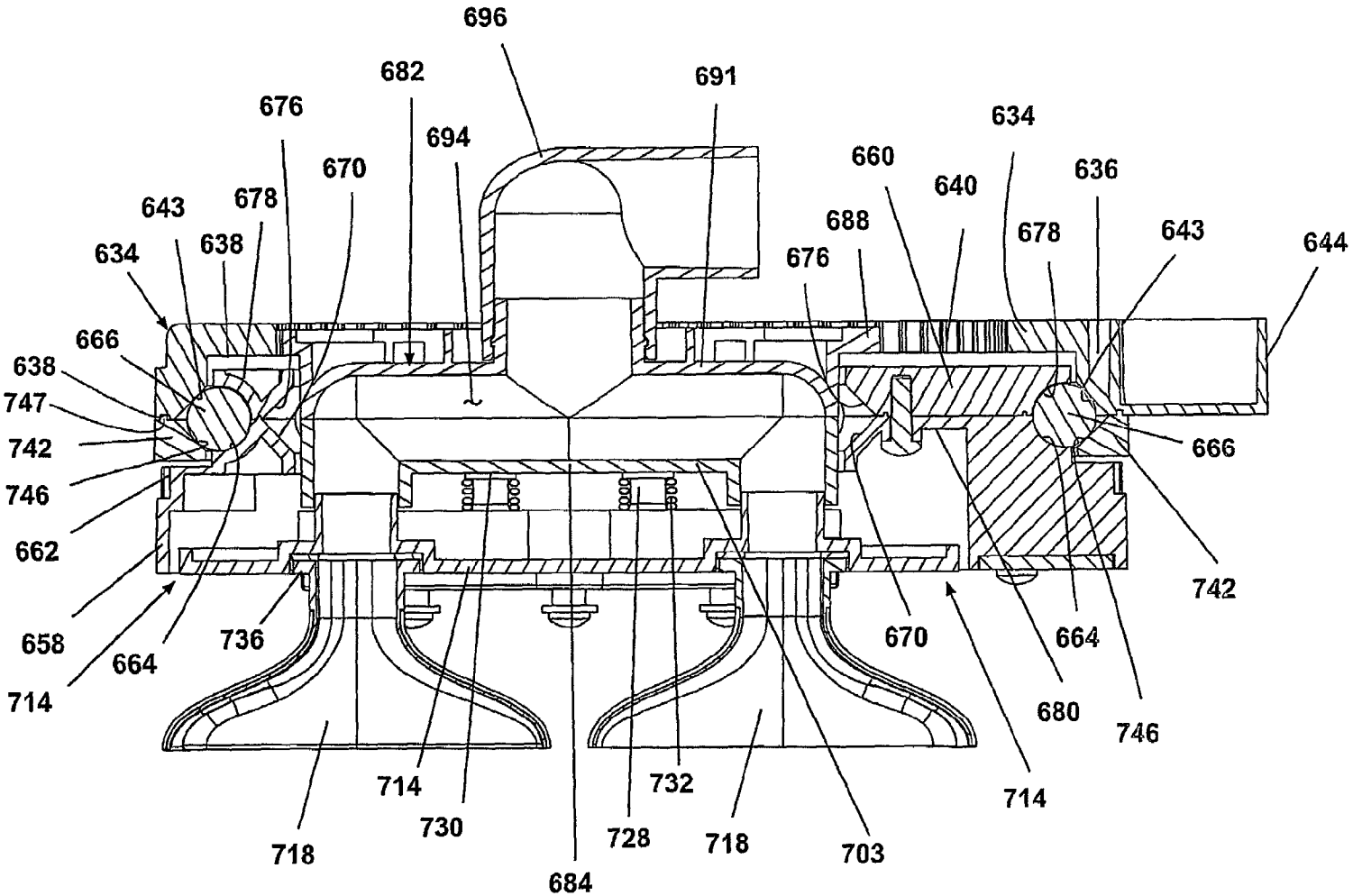
FIG. 28 is a sectional view of the carriage assembly taken along line 28—28 of FIG. 27.
Figure 29:
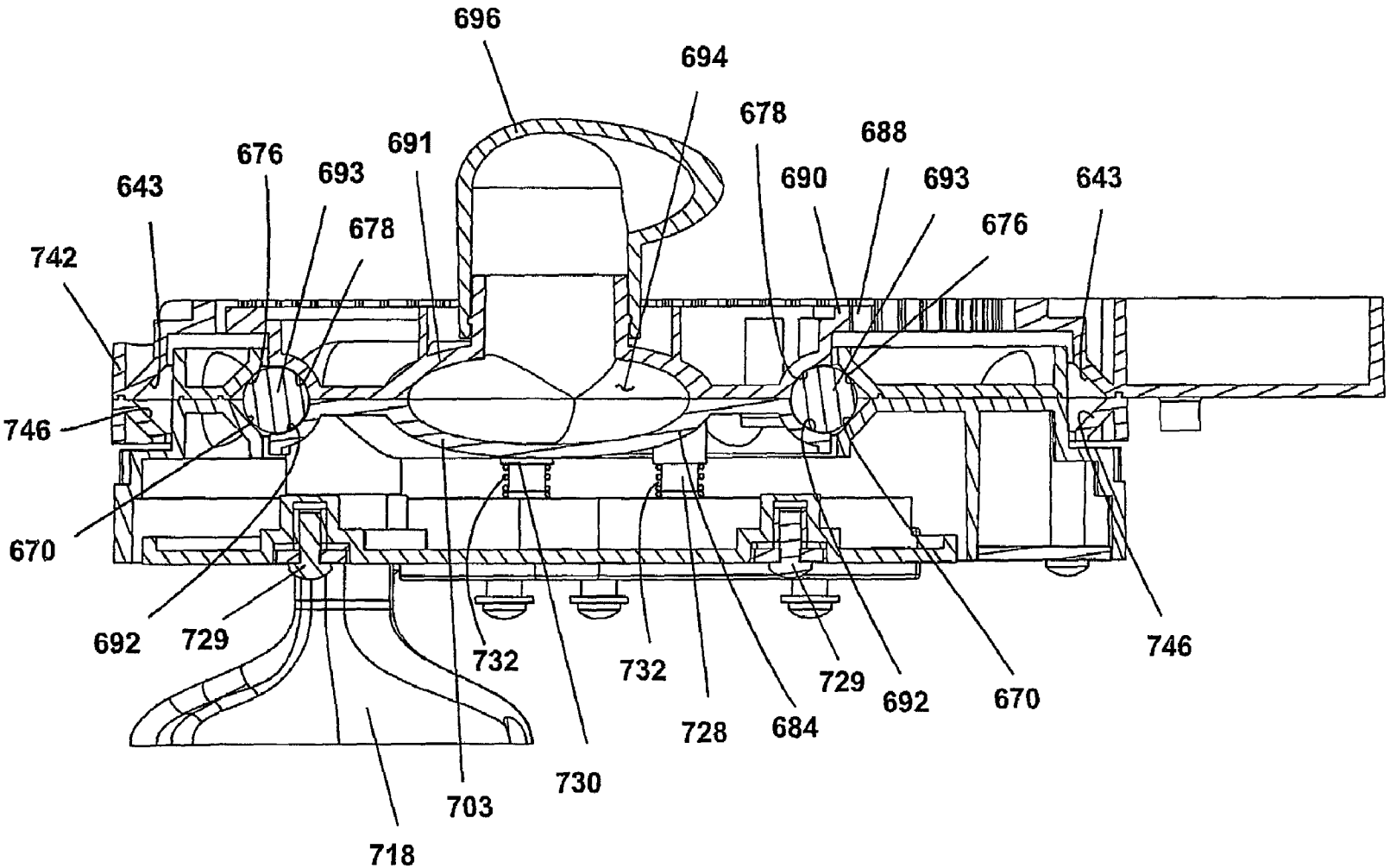
FIG. 29 is a sectional view of the carriage assembly taken along line 29—29 of FIG. 27

Referring to FIGS. 23–24, the recovery tank assembly 508, which is pair of a fluid extraction system, comprises a recovery tank 602 with single aperture 604, a centrally mounted standpipe 606 within the tank 602 and in fluid communication with the aperture 604, and a float 608 slidingly received on the standpipe 606. The recovery tank 602 is preferably blow molded of a transparent material for visibility of the interior of the recovery tank 602. At least one alignment protrusion 610 on an outer surface of the tank 602 mates with a corresponding recess (not shown) on the top housing 504 to maintain proper alignment of the tank 602 relative to the top housing 504. The standpipe 606 is a generally rectangular tube-like structure comprising an interior wall 612 that divides the interior of the standpipe 606 into two separate air paths: a dirty air path 614 and a clean air path 616. A lower end of the standpipe 606 defines a working air inlet 618 and a clean air outlet 620. An upper end of the standpipe 606 comprises a deflector 622 and a dirty air exhaust aperture 624 formed between a top wall of the standpipe 606 and the deflector 622. A clean air inlet aperture 626 formed in the standpipe 606 on a side opposite the dirty air exhaust aperture 624 is in fluid communication with the clean air path 616. The float 608 comprises a shut off plate 628 that moves between an open position and a closed position to open and close, respectively, the clean air inlet aperture 626. The open position is illustrated in FIG. 24, and the shut off plate 628 moves from the open position to the closed position when the debris and fluid in the recovery tank 602 exceeds a predetermined volume.

As in the BISSELL Little Green Model 1425 and disclosed in U.S. patent application Ser. No. 10/065,891 to Lenkiewicz, the motor/fan assembly 512 generates working air flow, and working/dirty air is drawn through the dirty air path 614 of the standpipe 606 via the working air inlet 618. The dirty air is drawn through the dirty air path 614 and impacts the deflector 622. Upon impact, the working air changes direction and slows, and the heavier dirt and liquid particles separate from the working air and fall to the bottom of the recovery tank 602. Lighter, clean air is thereafter drawn over the top of the deflector 622 and enters the clean air path 616 via the clean air inlet aperture 626 in the standpipe 606. The clean air travels down the clean air path 616 and through the clean air outlet 620 and is drawn into an inlet on the motor/fan assembly 512.

Referring to FIGS. 25–30, the carriage assembly 510 comprises a plurality of agitation assemblies 716 and suction nozzle assemblies 718. The carriage assembly 510 moves the agitation and suction nozzle assemblies 716, 718 through an orbital path to scrub the surface to be cleaned and suction excess liquid therefrom. A circular main ring gear 634 is rigidly attached to a bottom surface of the carriage assembly support 554 on the bottom housing 502 by a plurality of screws that pass through circumferentially disposed screw bosses 636. A recess 638 is formed around the perimeter in a bottom surface of the main ring gear 634. A plurality of ring gear teeth 640 formed on an inner perimeter defines a ring gear aperture 642. A chamfer generally extending from inboard the recess 638 to outboard the gear teeth 640 forms an upper race 643 of a bearing to be more fully described below. A cup-shaped gear motor well 644 with a corresponding gear motor aperture (not shown) formed through a bottom surface thereof extends tangentially from an outer perimeter of the ring gear 634. A commonly known gear box assembly 648 comprising a gear motor 650 and a planetary gear box assembly 652 are supported within the gear motor well 644. A motor pinion gear 654 is keyed to an output shaft on the planetary gear box assembly 652. In an alternate embodiment, the motor pinion gear 654 can be driven by a mechanical crank powered by the user.

A drive plate assembly 656 comprises a bottom drive gear 658 and a top drive plate 660. The bottom drive gear 658 comprises a plurality of drive gear teeth 662 on an outer perimeter that mesh with corresponding teeth on the motor pinion gear 654. A plurality of ball bearing sockets 664 located inboard of the drive gear teeth 662 house corresponding ball bearings 666. A pinion gear aperture 668 is formed in an eccentric manner on an inner perimeter of the bottom drive gear 658. A chamfer at an outer perimeter of the pinion gear aperture 668 serves as a race 670 for a corresponding pinion gear assembly 672, which will be further described hereinafter.

The top drive plate 660 is a generally plate like disc with a top pinion gear aperture 674 formed therethrough. A chamfer at an outer perimeter of the top pinion gear aperture 674 serves as an upper race 676 for the pinion gear assembly 672. A plurality of ball bearing sockets 678 are located on an outer perimeter of the top drive plate 660 and correspond with the ball bearing sockets 664 on the bottom drive gear 658. A plurality of screw bosses 680 provide locations for screws that secure the bottom drive gear 658 to the top drive plate 660.

The pinion gear assembly 672 comprises an upper pinion gear 682 and a lower pinion plate 684. The upper pinion gear 682 is a circular pan-like structure with stiffening ribs 686 radiating from a central hub to an outer perimeter. A plurality of gear teeth 688 formed along an outer perimeter of the upper pinion gear 682 mesh with the corresponding ring gear teeth 640. An outer perimeter wall 690 comprises a plurality of ball bearing sockets 692 similar to those previously described on the bottom drive gear 658 and the top drive plate 660. Ball bearings 693 similar to the ball bearings 66 reside partially within the ball bearing sockets 692. The upper pinion gear 682 includes an arched upper wall 691 that forms an upper portion of a working air plenum 694. The lower portion of the working air plenum 694 is defined by the lower pinion plate 684. A working air swivel fitting 696, which will be described in further detail hereinafter, couples with the upper pinion gear 682 at a top surface thereof for fluid communication with the working air plenum 694. A plurality of apertures (not shown) extend through the upper pinion gear 682 to receive a corresponding plurality of screws 695 to secure the upper pinion gear 682 to the lower pinion plate 684.

The lower pinion plate 684 further comprises an outer perimeter wall 700 with a plurality of ball bearing sockets 702 that correspond with the ball bearing sockets 692 on the upper pinion gear 682. An arched lower wall 704 in an upper surface of the lower pinion plate 684 forms the lower portion of the working air plenum 694. Hence, the working air plenum 694 is defined between the upper pinion gear 682 and the lower pinion plate 684. A plurality of apertures on the bottom surface of the lower pinion plate 684 form working air inlets 706 for the working air plenum 694. The lower pinion plate 684 is secured to the upper pinion gear 682 by a plurality of screws 695.

A circular agitation plate assembly 714 mounts the agitation assemblies 716 and suction nozzle assemblies 718 to the carriage assembly 510. The basic structure for the agitation plate assembly 714 is provided by a generally disc shaped agitation support plate 720. Each agitation assembly 716 comprises an agitation housing 724 with a plurality of commonly known brush bristles 726 protruding downwardly therefrom. Alternatively, other agitation devices or scrubbing implements can be used, such as a cloth and foam pads, in place of the bristles 726. Each agitation assembly 716 is fastened to the agitation support plate 720 in a conventional manner with screws 729. A plurality of upwardly protruding bosses 728 on the agitation support plate 720 slidingly engage an inner surface of a plurality of corresponding downwardly protruding screw bosses 730 on the lower pinion plate 684. Coil springs 732 is positioned over the lower pinion plate screw bosses 730 are captured between a lower surface of the lower pinion plate 684 and an upper surface of the agitation support plate 720. The coil springs 732 bias the agitation plate assembly 714 towards the surface to be cleaned to thereby facilitate enhanced agitation of the surface to be cleaned and seal the suction nozzles 734 with the surface to be cleaned. The biasing force is less than the weight of the housings 502, 504. In addition, the springs 732 absorb shock to minimize vibration of the carriage assembly 510. Reduced vibration results in a lower tendency for the unattended cleaner 500 to move or undesirably migrate during operation.

Figure 30:
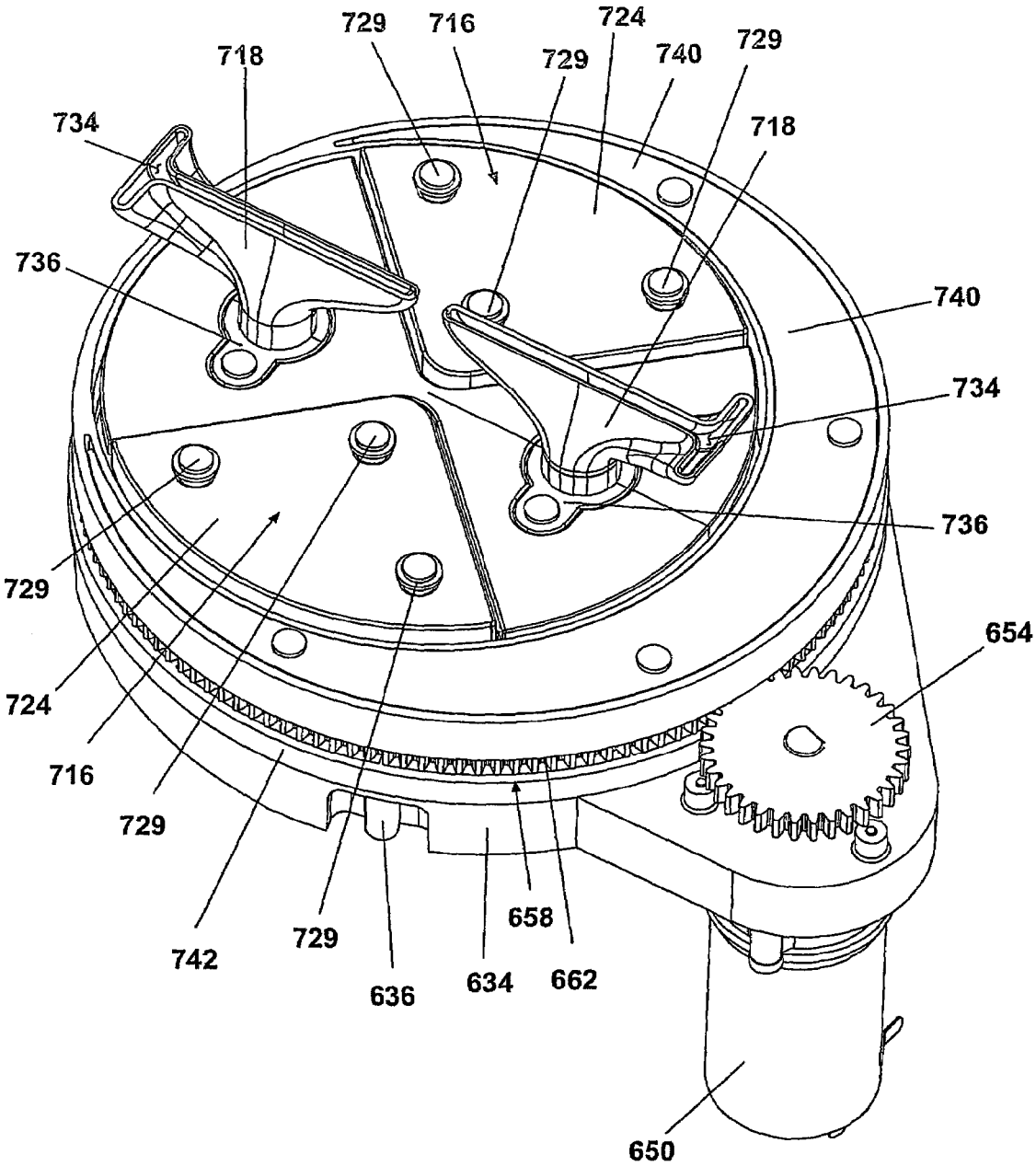
FIG. 30 is a bottom perspective view of the carriage assembly shown in FIG. 25.
Figure 31:
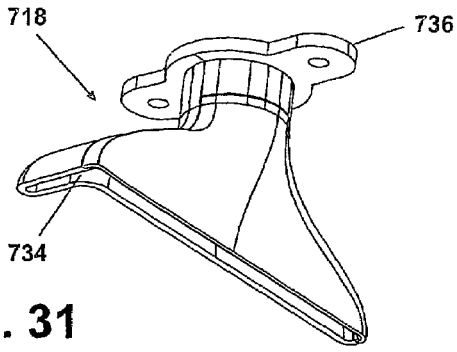
FIG. 31 is a perspective view of an alternative suction nozzle for the carriage assembly shown in FIG. 30.

With particular reference to FIG. 30, the suction nozzle assemblies 718 are shaped so as to maximize the coverage thereof over the surface to be cleaned when moving in an orbital path. A suction nozzle 734 forms a generally "T" shape at the surface to be cleaned. Alternative geometries for the suction nozzle 734 include narrow rectangular, oval, and "L" shaped openings, as illustrated in FIG. 31. A working air conduit is formed through the interior of the suction nozzle assembly 718 and terminating in a working air outlet 735 at an end opposite the suction nozzle 734. A suction nozzle flange 736 surrounds around the working air outlet 736 and provides an interface to sealingly couple the suction nozzle assembly 718 to the agitation support plate 720.

A crescent shaped cover plate 740 mates with a bottom surface of the bottom drive gear 658 to prevent debris from entering the bearing surfaces previously described. The cover plate 740 is essentially coplanar with the agitation support plate 720.

The carriage assembly 510 further comprises a retainer ring 742 that snaps into the recess 638 on the lower surface of the main ring gear 634. The retainer ring 742 comprises a generally vertical outer perimeter wall 744 and a downwardly sloping chamfer on an inner surface to form a bottom race 746 of an outer bearing surface formed between the main ring gear 634 and the bottom drive gear 658.

The carriage assembly 510 is assembled by attaching the suction nozzle assemblies 718 and agitation assemblies 716 to the agitation support plate 720. The agitation support plate 720 is mounted to the upper pinion gear 682 by screws that pass through the lower pinion plate 684. Before the agitation support plate 720 is fixed to the upper pinion gear 682, the ball bearings 693 are positioned in the corresponding ball bearing sockets 692 so that they are captured between the upper pinion gear 682 and the lower pinion plate 684. This assembly is mated with the bottom drive plate 658 so that the ball bearings 693 rest on the bottom drive gear race 670. The top drive plate 660 is assembled to the bottom drive plate 658 with the drive bear ball bearings 666 located in the corresponding ball bearing sockets 664. The retainer ring 742 is placed on the bottom drive gear 658 so that the ball bearings rest on the retainer ring race 746. The partially assembled structure is raised into position with the main ring gear race 643 so that the ball bearings 666 on the retainer ring race 746 contact the main ring gear race 643. A flange 747 on an upper surface of the retainer ring 742 is press fit to engage the recess 638 on the lower surface of the main ring gear 634 to lock the drive plate assembly 656 to the main ring gear 634.

Operation of the carriage assembly 510 is herein described with reference to FIGS. 25–27 and 30. When power is supplied to the gear motor 650, the shaft rotates and induces rotation of the motor pinion gear 654. The teeth of the motor pinion gear 654 mesh with the bottom drive gear teeth 662, thereby causing the bottom drive gear 658 to rotate about its centerline. As the bottom drive gear 658 rotates, the pinion gear assembly 672 rotates in an opposite direction about its centerline. Since the pinion gear aperture 668 is off center relative to the centerline of the bottom drive gear 658, the pinion gear assembly 672 and, thus, agitator plate assembly 714, the agitation assemblies 716, and the suction nozzle assemblies 718, move in an orbital motion. In other words, the pinion gear assembly 672 rotates about its own centerline while orbiting about the centerline of the bottom drive gear 658. The agitation assemblies 716 and the suction nozzle assemblies 718, therefore, move laterally relative to the surface to be cleaned and relative to the bottom housing 502, which remains stationary. The counter-rotational movement of the pinion gear assembly 672 is caused by a cam action, since the pinion gear assembly 672 is captured within the drive plate assembly 656 in an offset position. Because the gear teeth 688 on the upper pinion gear 682 engage with the fixed teeth 640 on the main ring gear 634, the rotation of the pinion gear assembly 672 is generated independent of the rotation of the drive plate assembly 656. The orbital motion ensures that all of the area under the carriage assembly support 554 is cleaned. Alternatively, the agitator plate assembly 714 can be aligned with the centerline of the bottom drive gear 658 so that the agitator plate assembly 714 rotates in a simple circular manner about a single axis. However, the orbital motion is preferred because the agitator assemblies 716 can completely cover the area under the agitator plate assembly 714 and cleans the center of the axis of rotation as well as the outer periphery of the agitator assemblies 716 and suction nozzle assemblies 718.

Figure 32:
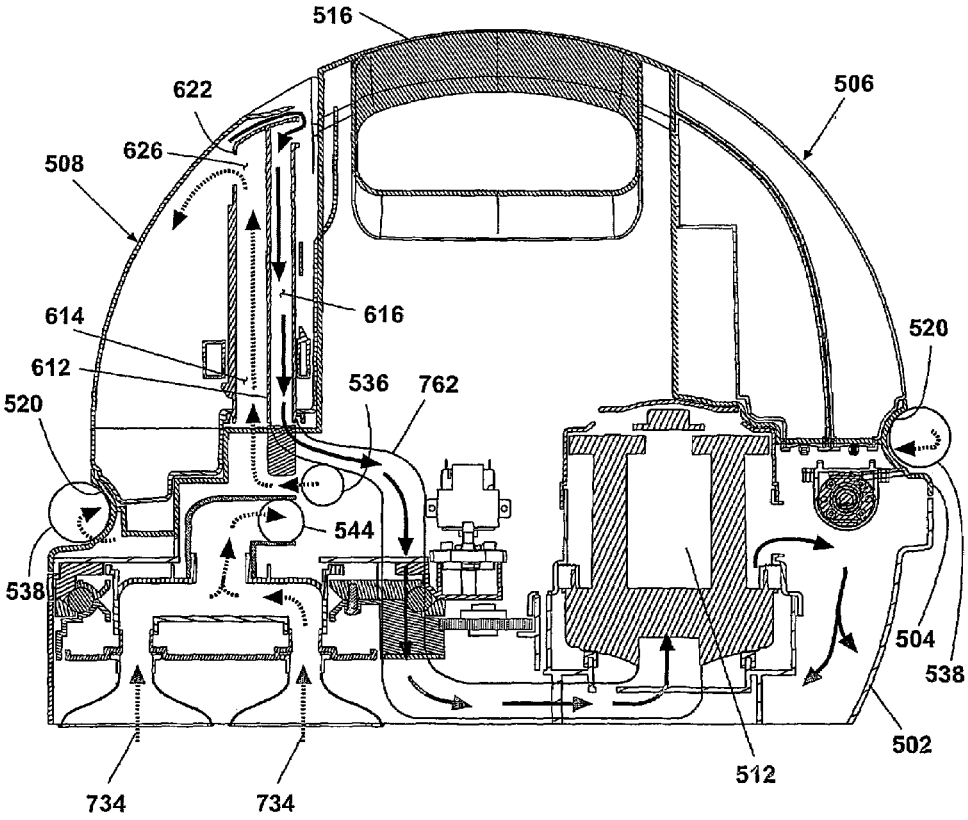
FIG. 32 is a sectional view of the unattended spot cleaning apparatus taken along line 32—32 of the FIG. 15.

The working air path of the spot cleaning apparatus 500 is illustrated in FIG. 32. The working air generated by the motor/fan assembly 512 is drawn from the surface to be cleaned through the suction nozzles 734, through the working air outlets 735 of the suction nozzle assemblies 718, into the working air plenum 694 defined between the upper pinion gear 682 and the lower pinion plate 684, and up through the swivel fitting 696. The working air flows through a flexible hose (not shown) connected to the swivel fitting 696 on one end and the suction hose fitting 536 on the other end. The working air flows through the suction hose 538 to the suction hose grip 540. When the spot cleaning apparatus 500 is being used in the manual mode, the user removes the suction hose grip 540 from the grip support fitting 544 and maneuvers the suction hose grip 540 and any tools attached thereto over the surface to be cleaned in a conventional manner. When the cleaning apparatus 500 is being used in the automatic or unattended mode, the suction hose grip 540 remains connected to the grip support fitting 544 to thereby fluidly connect the working air path from the suction hose 538 and through the suction hose grip 540 and grip support fitting 544 to a fixed working air conduit positioned within the bottom housing 502. The fixed working air conduit is coupled with the working air inlet 618 on the standpipe 606 in the recovery tank 602. The working air moves up through the dirty air path 614, impacts the deflector 622, and exits the standpipe 606 through the dirty air exhaust aperture 624 where solid debris falls from the air and settles under force of gravity to the bottom of the recovery tank 602. The clean air is then drawn into the clear air inlet aperture 626, down the clean air path 616 of the standpipe 606, out the clean air outlet 620, and into a clean air conduit 762 that is fluidly connected to an inlet on the motor/fan assembly 512. Exhaust air from the motor/fan assembly 512 exits the bottom housing 502 through the exhaust air apertures 553.

Referring to FIGS. 16 and 17, an optional ion generator 770 is located within the cavity formed between the top housing 504 and the bottom housing 502. The ion generator 770 uses electricity to create a spark in an air space. The spark creates ozone which is helpful in removing odors from the surrounding air. A similar ion generating device is more fully described in U.S. Pat. No. 2,297,933 to Yonkers, which is incorporated herein by reference in its entirety. The ion generator provides additional utility by functioning as a room air cleaner when the spot cleaning apparatus 500 is not being utilized for cleaning stains and spots from the carpet or other surface. Alternatively, the ion generator 770 can be placed anywhere in the working air path to provide additional cleaning or odor reduction benefits at the suction nozzle 734, in the recovery tank assembly 508, or near the motor exhaust apertures 553. Such a system is more fully described in U.S. Pat. No. 2,297,933 to Yonkers, U.S. Pat. No. 5,920,954 to Sepponen, and Japan Publication No. 7327873, all of which are incorporated herein by reference in their entirety.

The unattended cleaning apparatus 500 can be operated as an unattended spot cleaner, a manual spot cleaner, and optionally as a portable room air cleaner. To prepare the spot cleaning apparatus for use as the unattended spot cleaner or the manual spot cleaner, a pre-filled clean tank assembly 506 is placed on the top housing 504 above the pump assembly 514. When the clean tank assembly 506 is mounted onto the top housing 504, the umbrella valves 592 automatically open for fluid flow. The user positions the unattended cleaning apparatus 500 over the spot to be cleaned so that the agitation plate assembly 714 is centered over the spot. The user plugs the power cord into a convenient receptacle and selects a desired duty cycle by pressing one of the switches 539, 541, or 543 located on the top housing 504, which thereby powers the controller.

Figure 34:
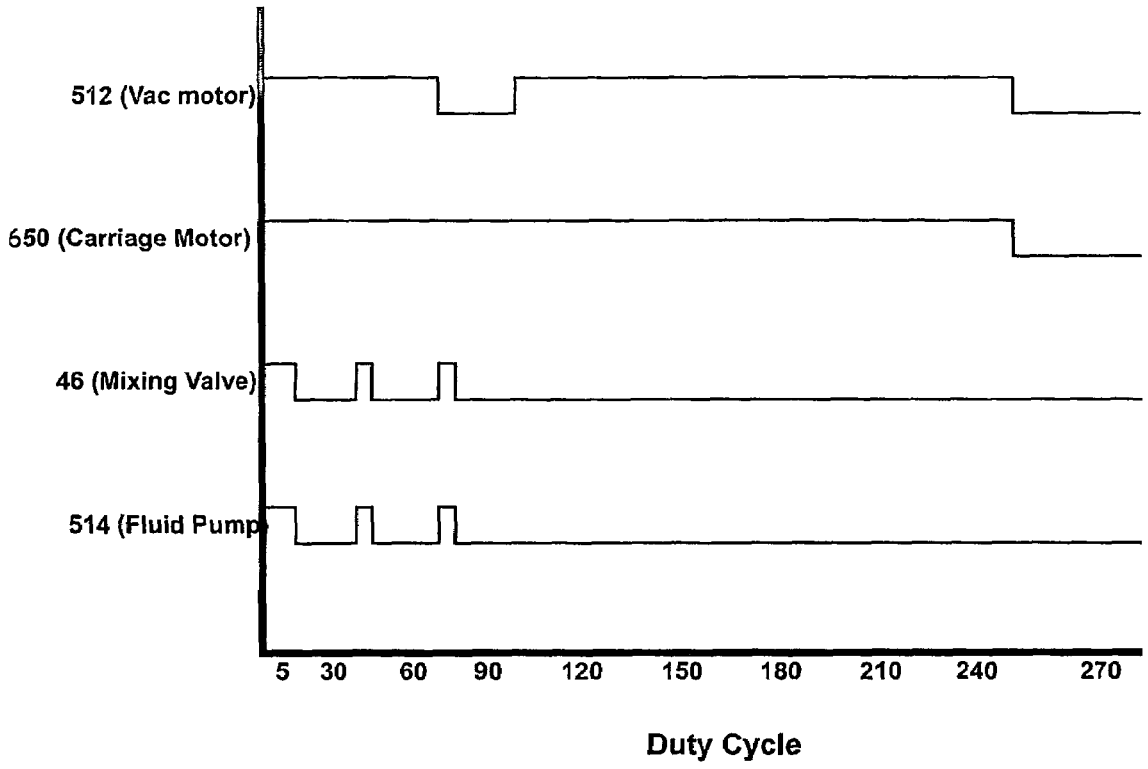
FIG. 34 is an exemplary graph of dwell time for powered components of the unattended spot cleaning apparatus shown in FIG. 15.

A graph depicting dwell time for powered components of the unattended spot cleaning apparatus 500 during an exemplary light duty cycle is presented as FIG. 34. During the light duty cycle, fluid can be delivered in three separate applications while simultaneously extracting spent fluid for an approximately 60 and 90 second suction intervals. Preferably, one half of the available fluid is dispersed immediately upon activation of the spot cleaning apparatus 500, followed by two additional fluid applications cycles, wherein each additional fluid application cycle delivers approximately one quarter of the initial volume. Preferably, the cleaning fluid is delivered at a flow rate of 1000 mL/minute. As schematically indicated by the dwell time in FIG. 34 for the mixing valve 46, if utilized, and the fluid pump assembly 514, the preferred fluid delivery cycle comprises 4.5 seconds on, 25.5 seconds off, 2.25 seconds on, 27.75 seconds off, and a final 2.25 seconds on. The gear motor 650 runs constantly throughout the light duty cycle to constantly move the agitation plate assembly 714. Suction remains active except for 30 seconds between the 60 second and 90 second intervals. The total duration of the light duty cycle is approximately 4 minutes. An exemplary heavy duty cycle completes two of the aforementioned cycles in series for a total run time of 8 minutes. Other duty cycles can be programmed into the controller 106 to vary the fluid delivery, the fluid mixing through the mixing valve 46, agitation, and suction dwell times. Further, the duty cycles can include a non-powered dwell time wherein the fluids are allowed to penetrate and work on the spot while all other functions are temporarily suspended. At a convenient time for the user, the user returns to the unattended spot cleaning apparatus 500, unplugs the power cord, removes the recovery tank assembly 508 from the top housing 504, and cleans the recovery tank assembly 508.

The optional ion generator 770 can be powered at any time (i.e., whether the spot cleaning cycle is running or not) to provide constant air cleaning. In another embodiment, the ion generator 770 is controlled by a separate switch or by sensors and the controller 106 for optimum automatic run time.

The preferred invention has been described as an unattended spot cleaning apparatus. It can also be appreciated that several subsets of the invention can be recombined in new ways to provided various configurations. Any combination of a floor condition sensor system, fluid distribution system, fluid recovery system, or agitation system can be used to solve specific cleaning problems not requiring all the capabilities of all the subsystems herein described.

While the invention has been specifically described in connection with certain specific embodiments thereof, it is to be understood that this is by way of illustration and not of limitation. For example, the invention can be practiced with a single fluid tank as well as multiple fluid tanks with a mixer for the fluids from the multiple fluid tanks. Reasonable variation and modification are possible within the scope of the forgoing description and drawings without departing from the scope of the invention that is described in the appended claims.

We claim:

1. A floor cleaning apparatus comprising:

a housing with a bottom portion that is adapted to rest on a surface being cleaned and that defines an opening in an underside of the housing;

a fluid delivery system mounted to the housing and including a fluid distributor for delivering a cleaning fluid to the surface to be cleaned beneath the opening in the underside the housing and a fluid flow regulator connected to the fluid distributor for controlling the flow of cleaning fluid to the fluid distributor;

a fluid extraction system including a suction nozzle connected to a fan driven by a fan motor for recovering soiled cleaning fluid from the surface to be cleaned beneath the opening in the underside of the housing;

a carriage mounting the suction nozzle to the housing for movement with respect to the housing along the surface to be cleaned;

a controller operably connected to of the fluid flow regulator and the fan motor for independently controlling the delivery of cleaning fluid to the surface being cleaned and the recovery of soiled cleaning fluid from the surface to be cleaned in a predetermined relationship.

2. The floor cleaning apparatus according to claim 1 and further including a scrubbing implement mounted to the carriage for translational movement for scrubbing contact with the surface to be cleaned.

3. The floor cleaning apparatus according to claim 2 wherein the carriage mounts the scrubbing implement, the fluid distributor, and the suction nozzle.

4. The floor cleaning apparatus according to claim 1 wherein the movement of the suction nozzle is orbital.

5. The floor cleaning apparatus according to claim 1 wherein the carriage comprises a gear system for motion of the fluid distributor and the suction nozzle with respect to the housing.

6. The floor cleaning apparatus according to claim 1 wherein the movement of the suction nozzle is linear.

7. The floor cleaning apparatus according to claim 1 wherein the movement of the suction nozzle is circular.

8. The floor cleaning apparatus according to claim 1 and further including a brush mounted to the carriage for movement with respect to the housing in scrubbing contact with the surface to be cleaned.

9. The floor cleaning apparatus according to claim 1 and further including a cloth mounted to the carriage for movement in scrubbing contact with the surface to be cleaned.

10. The floor cleaning apparatus according to claim 1 and further including a foam pad mounted to the carriage for movement in scrubbing contact with the surface to be cleaned.

11. The floor cleaning apparatus according to claim 1 wherein the distributor comprises at least one spray nozzle.

12. The floor cleaning apparatus according to claim 1 wherein the distributor is a manifold with spaced openings.

13. The floor cleaning apparatus according to claim 1 wherein the suction nozzle is L-shaped.

14. The floor cleaning apparatus according to claim 1 wherein the suction nozzle is T shaped.

15. The floor cleaning apparatus according to claim 1 and further comprising a motor mounted to the housing and connected to the carriage for driving the movement of the carriage with respect to the housing.

16. The floor cleaning apparatus according to claim 15 and further comprising a power supply connected to the motor and the controller is connected to the power supply for controlling the power to the motor.

17. The floor cleaning apparatus according to claim 16 wherein the controller is programmed to supply power to the motor for a first predetermined period of time and to discontinue power to the motor after the first predetermined period of time.

18. The floor cleaning apparatus according to claim 1 wherein the fluid supply system comprises a first fluid tank with an outlet opening and a second fluid tank with an outlet opening, wherein the outlet openings of the first fluid tank and the second fluid tank are connected to supply a mixture of first and second fluids from the first fluid tank and the second fluid tank to the fluid distributor.

19. The floor cleaning apparatus according to claim 18 wherein the outlet openings of the first fluid tank and the second fluid tank are connected through a mixing valve.

20. The floor cleaning apparatus according to claim 19 wherein the controller is connected to the mixing valve, and the controller is programmed to control the relative amounts of the first and second fluids combined in the mixing valve.

21. A floor cleaning apparatus according to claim 20 and further including a scrubbing implement mounted to the carriage for translational movement in scrubbing contact with the surface to be cleaned and the controller is operably connected the fluid flow regulator, the fan motor, the mixing valve and the carriage, and wherein the controller is programmed with multiple duty cycles to vary the fluid delivery, fluid mixing, scrubbing, and suction dwell times.

22. A floor cleaning apparatus according to claim 21 and further comprising a floor condition sensor mounted to the housing for detecting the level of soil on the floor to be cleaned and for generating a control signal representative thereof; and wherein the controller is adapted to select one of the multiple duty cycles responsive to the control signal.

23. The floor cleaning apparatus according to claim 20 wherein the controller is programmed to control the mixing valve to deliver a predetermined concentration of the first fluid and the second fluid to the fluid distributor for a first predetermined length of time and to deliver only the second fluid for a rinse cycle for a second predetermined length of time.

24. The floor cleaning apparatus according to claim 23 wherein the fluid flow regulator comprises a controllable flow valve or a controllable pump between the mixing valve and the fluid distributor and the controller is connected to the controllable flow valve or controllable pump to control the flow of fluid from the mixing valve to the fluid distributor.

25. The floor cleaning apparatus according to claim 24 wherein the controller is programmed to open the flow control valve or operate the pump during a third predetermined period of time and to close the flow control valve or cease operation of the pump during a fourth predetermined period of time.

26. The floor cleaning apparatus according to claim 1 wherein the fluid extraction system further comprises a hose connected at one end to the housing and at another end to a surface cleaning tool for extraction of fluids from surfaces other than beneath the opening in the underside of the housing.

27. The floor cleaning apparatus according to claim 26 wherein the fluid supply system further includes a fluid supply conduit associated with the hose and connected to the surface cleaning tool for delivering fluids to areas other than beneath the opening in the underside of the housing.

28. The floor cleaning apparatus according to claim 1 and further comprising a cord wrap element mounted to the housing for movement between an extended position for wrapping an electrical cord in a compact configuration and a retracted position for concealing the cord wrap element.

29. The floor cleaning apparatus according to claim 28 wherein the biasing force of the biasing element is less than the weight of the housing.

30. The floor cleaning apparatus according to claim 1 and further comprises a resilient biasing element between the housing and the suction nozzle for resiliently biasing the suction nozzle onto the surface to be cleaned.

31. The floor cleaning apparatus according to claim 1 and further comprising an ion generator mounted on the housing.

32. The floor cleaning apparatus according to claim 1 and further comprising a sonic generator mounted to the housing for directing sound waves to the surface to be cleaned at a frequency that loosens debris from the surface.

33. The floor cleaning apparatus according to claim 1 and further comprising a plurality of condition floor sensors mounted to the housing for detecting the level of soil on the floor to be cleaned and connected to the controller, wherein the floor sensors are adapted to generate a control signal representative of the level of soil on the floor to be cleaned and applying the control signal to the controller for controlling at least one of the fluid delivery system and the fluid extraction system in response thereto.

34. A surface cleaning apparatus according to claim 1 wherein the carriage further mounts the fluid distributor.

35. A floor cleaning apparatus according to claim 1 and further comprising a plurality of floor condition sensors mounted to the housing for detecting the level of soil on the floor to be cleaned and for generating a control signal representative thereof and wherein the controller is adapted to adjust the delivery of cleaning fluid responsive to the control signal.

36. A floor cleaning apparatus according to claim 1 and further comprising a mechanism for driving the carriage in at least two translational directions.

37. A floor cleaning apparatus according to claim 36 wherein the at least two translational directions are opposite each other.

38. A floor cleaning apparatus according to claim 1 and further comprising a heater incorporated within the fluid delivery system to heat the cleaning fluid to a temperature less than boiling prior to delivery of the cleaning fluid to the surface to be cleaned.

39. A floor cleaning apparatus according to claim 1 and further comprising an electrically powered drive for driving the translational movement of the carriage and a battery power source mounted to the housing and connected to the electrically powered drive for supplying electrical energy thereto.

40. A floor cleaning apparatus according to claim 1 wherein at least a portion of the housing is adjacent the opening in an underside of the housing is made of a transparent or translucent material so that the area within the opening and the carriage are visible to the user from outside the housing.

41. A floor cleaning apparatus according to claim 1 and further comprising a handle integrally formed at an upper portion of the housing to facilitate easy carrying of the floor cleaning apparatus.

42. A floor cleaning apparatus according to claim 1 and further comprising grippers on the bottom portion of the housing to increase friction between surface being cleaned and the bottom portion of the housing that rests on the surface and thereby minimize relative movement between the housing and the surface to be cleaned.

43. A floor cleaning apparatus according to claim 1 wherein the fluid delivery system includes at least one fluid tank and wherein the at least one fluid tank is pressurized with an aerosol propellant.

44. A floor cleaning apparatus comprising:

a housing with a bottom portion that is adapted to rest on a surface being cleaned and that defines an opening in an underside of the housing;

a fluid delivery system mounted to the housing and including a fluid distributor for delivering a cleaning fluid to the surface to be cleaned beneath the opening in the underside the housing;

a fluid extraction system including a suction nozzle connected to a fan driven by a fan motor for recovering soiled cleaning fluid from the surface to be cleaned beneath the opening in the underside of the housing;

carriage mounting the suction nozzle to the housing for movement with respect to the housing and with respect to the surface to be cleaned;

a carriage motor mounted to the housing and connected to the carriage for driving the movement of the carriage with respect to the housing;

a power supply connected to the carriage motor and to the fan motor;

a controller mounted to the housing and to the power supply for controlling the power supply to the carriage motor and to the fan motor; and the controller is programmed to supply power to the carriage motor for a first and second predetermined period of time and supply power to the fan motor for the first period of time and to discontinue power to the fan motor for a second predetermined period of time.

45. The floor cleaning apparatus according to claim 44 wherein the fluid distributor is also mounted to the carriage.

46. A floor cleaning apparatus comprising:

a housing with a bottom portion that is adapted to rest on a surface being cleaned and that defines an opening in an underside of the housing;

a fluid delivery system mounted to the housing and including a fluid distributor for delivering a cleaning fluid to the surface to be cleaned beneath the opening in the underside the housing;

a fluid extraction system including a suction nozzle connected to a fan driven by a fan motor for recovering soiled cleaning fluid from the surface to be cleaned beneath the opening in the underside of the housing;

carriage mounting the suction nozzle to the housing for movement with respect to the housing and with respect to the surface to be cleaned;

a plurality of floor condition sensors mounted to the housing for detecting the level of soil on the floor to be cleaned and for generating a control signal representative thereof; and the controller is adapted to adjust the delivery of cleaning fluid to the surface to be cleaned responsive to the control signal.

47. A floor cleaning apparatus comprising:

a housing with a bottom portion that is adapted to rest on a surface being cleaned and that defines an opening in an underside of the housing;

a fluid delivery system mounted to the housing and including a fluid distributor for delivering a cleaning fluid to the surface to be cleaned beneath the opening in the underside the housing;

a fluid extraction system including a suction nozzle connected to a fan driven by a fan motor for recovering soiled cleaning fluid from the surface to be cleaned beneath the opening in the underside of the housing;

carriage mounting the suction nozzle to the housing for movement with respect to the housing and with respect to the surface to be cleaned;

a carriage motor mounted to the housing and connected to the carriage for driving the movement of the carriage with respect to the housing;

power supply connected to the carriage motor and to the fan motor;

a controller mounted to the housing and to the power supply for controlling the power supply to the carriage motor and to the fan motor; and the controller is programmed to supply power to the carriage motor the fan motor for a predetermined period of time and to discontinue power to the carriage motor and the fan motor subsequent to the predetermined period of time.

48. A floor cleaning apparatus comprising:

a housing with a bottom portion that is adapted to rest on a surface being cleaned and that defines an opening in an underside of the housing;

a fluid delivery system mounted to the housing and including a fluid distributor and a fluid flow regulator connected to the fluid distributor for controlling the flow of cleaning fluid to the fluid distributor for delivering a cleaning fluid to the surface to be cleaned beneath the opening in the underside the housing;

a fluid extraction system including a suction nozzle connected to a fan driven by a fan motor for recovering soiled cleaning fluid from the surface to be cleaned beneath the opening in the underside of the housing;

carriage mounting the suction nozzle to the housing for movement with respect to the housing and with respect to the surface to be cleaned;

a scrubbing implement mounted to the carriage for translational movement in scrubbing contact with the surface to be cleaned;

a carriage motor mounted to the housing and connected to the carriage for driving the movement of the carriage with respect to the housing;

a power supply connected to the carriage motor and to the fan motor;

a controller mounted to the housing and connected to the power supply for controlling the power supply to the carriage motor and to the fan motor, and the controller is operably connected the fluid flow regulator; and wherein the controller is programmed with multiple duty cycles to vary the fluid delivery, scrubbing, and suction dwell times.

49. A floor cleaning apparatus according to claim 48 and further comprising at least one floor condition sensor mounted to the housing for detecting the level of soil on the floor to be cleaned and for generating a control signal representative thereof and wherein the controller is adapted to select one of the multiple duty cycles responsive to the control signal.

50. A floor cleaning apparatus according to claim 48 wherein the fluid supply system comprises a first fluid tank with an outlet opening and a second fluid tank with an outlet opening, wherein the outlet openings of the first fluid tank and the second fluid tank are connected to supply a mixture of first and second fluids from the first fluid tank and the second fluid tank to the fluid distributor, the outlet openings of the first fluid tank and the second fluid tank are connected through a mixing valve; and wherein the controller is connected to the mixing valve, and the controller is programmed to control the relative amounts of the first and second fluids combined in the mixing valve during the multiple duty cycles.

* * * * *